US009061786B2

(12) United States Patent
Smith et al.

(10) Patent No.: US 9,061,786 B2
(45) Date of Patent: Jun. 23, 2015

(54) BLANK OF SHEET MATERIAL AND METHODS AND APPARATUS FOR FORMING A CONTAINER FROM THE BLANK

(75) Inventors: Kenneth C. Smith, Hiram, GA (US); Benjamin D. Strong, Covington, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 1961 days.

(21) Appl. No.: 11/553,080

(22) Filed: Oct. 26, 2006

(65) Prior Publication Data

US 2008/0099541 A1 May 1, 2008

(51) Int. Cl.

| | |
|---|---|
| ***B65D 5/06*** | (2006.01) |
| ***B31B 1/28*** | (2006.01) |
| ***B31B 3/00*** | (2006.01) |
| ***B65D 5/44*** | (2006.01) |

(52) U.S. Cl.

CPC ... *B65D 5/06* (2013.01); *B31B 1/28* (2013.01); *B31B 3/00* (2013.01); *B31B 2201/2604* (2013.01); *B65D 5/443* (2013.01)

(58) Field of Classification Search

CPC ..... B65D 5/029
USPC ..... 229/110, 183, 2.5, 141, 154, 109, 5.5, 229/930, 931, 112
See application file for complete search history.

(56) References Cited

U.S. PATENT DOCUMENTS

| | | | | |
|---|---|---|---|---|
| 1,425,549 | A | | 8/1922 | Scruby |
| 1,863,260 | A | * | 6/1932 | Buren ..... 229/154 |
| 1,892,715 | A | | 1/1933 | Wellman |
| 2,156,999 | A | * | 5/1939 | McNeil ..... 229/109 |
| 2,565,188 | A | | 8/1951 | Welshenbach |
| 2,787,408 | A | | 4/1957 | Andre |
| 3,032,252 | A | * | 5/1962 | Hill ..... 229/183 |
| 3,844,088 | A | | 10/1974 | McDonough et al. |
| 3,944,072 | A | | 3/1976 | Budlington et al. |
| 3,985,287 | A | * | 10/1976 | Stetler ..... 229/143 |
| 3,990,210 | A | | 11/1976 | McDonough et al. |
| 4,094,124 | A | | 6/1978 | Ljungcrantz |
| 4,119,266 | A | | 10/1978 | Dempster |
| 4,225,078 | A | | 9/1980 | Croley |
| 4,260,100 | A | | 4/1981 | Hoffman |
| 4,360,146 | A | | 11/1982 | Koltz |

(Continued)

FOREIGN PATENT DOCUMENTS

WO WO 2004101375 A1 * 11/2004

*Primary Examiner* — Justin Larson
*Assistant Examiner* — Phillip Schmidt
(74) *Attorney, Agent, or Firm* — Armstrong Teasdale LLP

(57) ABSTRACT

A container formed from a blank sheet of material. The container includes a plurality of panels that are coupled together along substantially parallel fold lines and that include a first major panel and a second major panel. The plurality of panels form a plurality of sides of the container and define a cavity with a bottom and a top. An outer bottom flap is coupled to the first major panel and has a plurality of edges, and an inner bottom flap is coupled to the second major panel. The container also includes a plurality of flanges where each flange is coupled to one edge of the outer bottom flap. When the container is assembled, the inner bottom flap is positioned adjacent to the cavity bottom and the outer bottom flap is positioned adjacent to the inner bottom flap in a face-to-face relationship forming a bottom of the container. Each flange is folded and coupled to an outer surface of one side of the container.

20 Claims, 18 Drawing Sheets

(56) References Cited

U.S. PATENT DOCUMENTS

| | | | | | |
|---|---|---|---|---|---|
| 4,361,267 | A | | 11/1982 | Wozniacki | |
| 4,392,607 | A | | 7/1983 | Perkins, Jr. | |
| 4,448,008 | A | | 5/1984 | Pankratz et al. | |
| 4,470,540 | A | | 9/1984 | Koltz | |
| 4,511,080 | A | * | 4/1985 | Madsen et al. | 229/110 |
| 4,552,293 | A | * | 11/1985 | Blagg et al. | 229/400 |
| 4,641,777 | A | * | 2/1987 | Fronduti | 229/110 |
| 4,702,408 | A | | 10/1987 | Powlenko | |
| 4,984,734 | A | | 1/1991 | Zion et al. | |
| 5,337,916 | A | * | 8/1994 | Voss | 229/182 |
| 5,630,543 | A | | 5/1997 | Dugan | |
| 5,704,540 | A | | 1/1998 | Coalier et al. | |
| 5,752,648 | A | | 5/1998 | Quaintance | |
| 5,878,946 | A | | 3/1999 | Frerot et al. | |
| 5,938,108 | A | | 8/1999 | Williams et al. | |
| 5,941,452 | A | | 8/1999 | Williams et al. | |
| 5,943,840 | A | | 8/1999 | Nilsson et al. | |
| 6,042,527 | A | | 3/2000 | Anderson et al. | |
| 6,202,920 | B1 | | 3/2001 | Auclair | |
| 6,446,859 | B1 | * | 9/2002 | Holladay | 229/109 |
| 6,588,651 | B2 | | 7/2003 | Quaintance | |
| 6,783,058 | B2 | | 8/2004 | Quaintance | |
| 6,932,266 | B2 | | 8/2005 | Jones et al. | |
| 2002/0047040 | A1 | * | 4/2002 | Andrews et al. | 229/112 |
| 2005/0067476 | A1 | * | 3/2005 | Hengami | 229/129.1 |
| 2005/0072796 | A1 | * | 4/2005 | Penfold | 222/105 |
| 2005/0103833 | A1 | * | 5/2005 | Aubry et al. | 229/235 |
| 2005/0263573 | A1 | | 12/2005 | Goglio | |
| 2005/0284922 | A1 | | 12/2005 | Feltz | |
| 2006/0027638 | A1 | | 2/2006 | Jones et al. | |
| 2006/0124709 | A1 | * | 6/2006 | Hengami | 229/110 |
| 2006/0169755 | A1 | | 8/2006 | Spivey, Sr. | |
| 2006/0180642 | A1 | | 8/2006 | Zacher et al. | |
| 2011/0062223 | A1 | * | 3/2011 | Wall et al. | 229/109 |

* cited by examiner

BLANK OF SHEET MATERIAL AND METHODS AND APPARATUS FOR FORMING A CONTAINER FROM THE BLANK

BACKGROUND OF THE INVENTION

This invention relates generally to containers formed from blanks of sheet material, and, more specifically, to a blank of sheet material for forming a container, and methods and apparatus for forming the container.

Paperboard containers are often used to hold granular products (e.g., sugar, flour, or sand), viscous products (e.g., ice cream), or other articles. If the container has a crack or small opening, then some of the product might escape the container by either leaking or sifting. In order to prevent this, a manufacturer might use additional packaging, such as adding a plastic bag or another kind of insert. Accordingly, such containers are costly to manufacture and require more attention in making them, and such containers possibly require a more sophisticated type machine to manufacture them.

BRIEF DESCRIPTION OF THE INVENTION

In one aspect, a container formed from a blank sheet of material is provided. The container includes a plurality of panels that are coupled together along substantially parallel fold lines and that include a first major panel and a second major panel. The plurality of panels form a plurality of sides of the container and define a cavity with a bottom and a top. An outer bottom flap is coupled to the first major panel and has a plurality of edges, and an inner bottom flap is coupled to the second major panel. The container also includes a plurality of flanges where each flange is coupled to one edge of the outer bottom flap. When the container is assembled, the inner bottom flap is positioned adjacent to the cavity bottom and the outer bottom flap is positioned adjacent to the inner bottom flap in a face-to-face relationship forming a bottom of the container. Each flange is folded and coupled to an outer surface of one side of the container.

In another aspect, a blank of sheet material for constructing a container is provided. The blank includes a plurality of panels that are coupled together in a series along substantially parallel fold lines and that include a first major panel and a second major panel. An inner bottom flap is coupled to the second major panel, and an outer bottom flap is coupled to the first major panel. The outer bottom flap includes a plurality of edges forming an outer bottom flap perimeter. The blank also includes a plurality of flanges where each flange is coupled to one edge of the outer bottom flap.

In another aspect, a method for making a container from a blank sheet of material is provided. The blank includes a plurality of panels that are coupled together in a series along substantially parallel fold lines. The plurality of panels include a first major panel and a second major panel. An outer bottom flap is coupled to the first major panel along a fold line and includes a plurality of edges. Each flange of a plurality of flanges is coupled along a fold line to one edge of the outer bottom flap. An inner bottom flap is coupled to the second major panel along a fold line. The method includes forming a plurality of sides of the container by folding the plurality of panels along the fold lines and coupling at least two of the panels together. The plurality of sides define a cavity having a bottom and a top, and each side of the container has an interior surface and an exterior surface. The method also includes folding the inner bottom flap substantially perpendicular to the second major panel such that the inner bottom flap substantially covers the cavity bottom, and folding the outer bottom flap substantially perpendicular to the first major panel such that the outer bottom panel is adjacent to the inner bottom flap in a face-to-face relationship. The method also includes folding each flange along a corresponding fold line and coupling each flange to the exterior surface of one side of the plurality of sides.

In another aspect, a machine for forming a container from a blank sheet of material is provided. The blank includes a plurality of panels coupled together for forming sides of the container. The panels include at least a first major panel and a second major panel. The blank also includes an inner bottom flap that is coupled to the first major panel, an outer bottom flap that is coupled to the second major panel, and a plurality of flanges that are coupled to the outer bottom flap. The machine includes a body, an internal mandrel that is mounted on the body and has a shape complimentary to an internal shape of at least a portion of the container. The machine further includes a plurality of members mounted on the body and adjacent to the mandrel. The plurality of members includes at least one wrapping member for folding a portion of the blank around the mandrel, and a bottom assembly for folding the inner bottom flap against the mandrel and the outer bottom flap against an outer surface of the inner bottom flap. The machine also includes a flange sealing mechanism for folding at least one flange against an outer surface of at least one side of the container and coupling the at least one flange to the at least one side of the container.

In another aspect, a method for forming a container from a blank of sheet material using a machine is provided. The machine includes a body and an internal mandrel for folding the blank against the mandrel. The blank includes a plurality of panels, an inner bottom flap and an outer bottom flap, and a plurality of flanges that are coupled to the outer bottom flap. The method includes wrapping a portion of the blank around the internal mandrel by folding a portion of the blank around the internal mandrel with at least one wrapping member, forming a bottom of the container by folding the inner bottom flap against the mandrel, folding the outer bottom flap against an outer surface of the inner bottom flap, and coupling the inner bottom flap and outer bottom flap. The method also includes folding at least one flange against an outer surface of at least one side of the container, and coupling the at least one flange to the at least one side.

DETAILED DESCRIPTION OF THE INVENTION

The present invention is described below in reference to its application in connection with and construction of a container. However, it will be apparent to those skilled in the art and guided by the teachings herein provided that the invention is likewise applicable to any suitable storage and/or container including, without limitation, a carton, a tray or a box.

In one embodiment, a container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided.

In a particular embodiment, the container includes a marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. The container may have any suitable size, shape and/or configuration, i.e. number of sides, whether such sizes, shapes and/or configurations are described and/or illustrated herein. For example, in one embodiment, the container includes a shape that provides functionality, such as a shape that facilitates transporting the container and/or a shape that facilitates stacking and/or arrangement of a plurality of containers.

Figure 1:
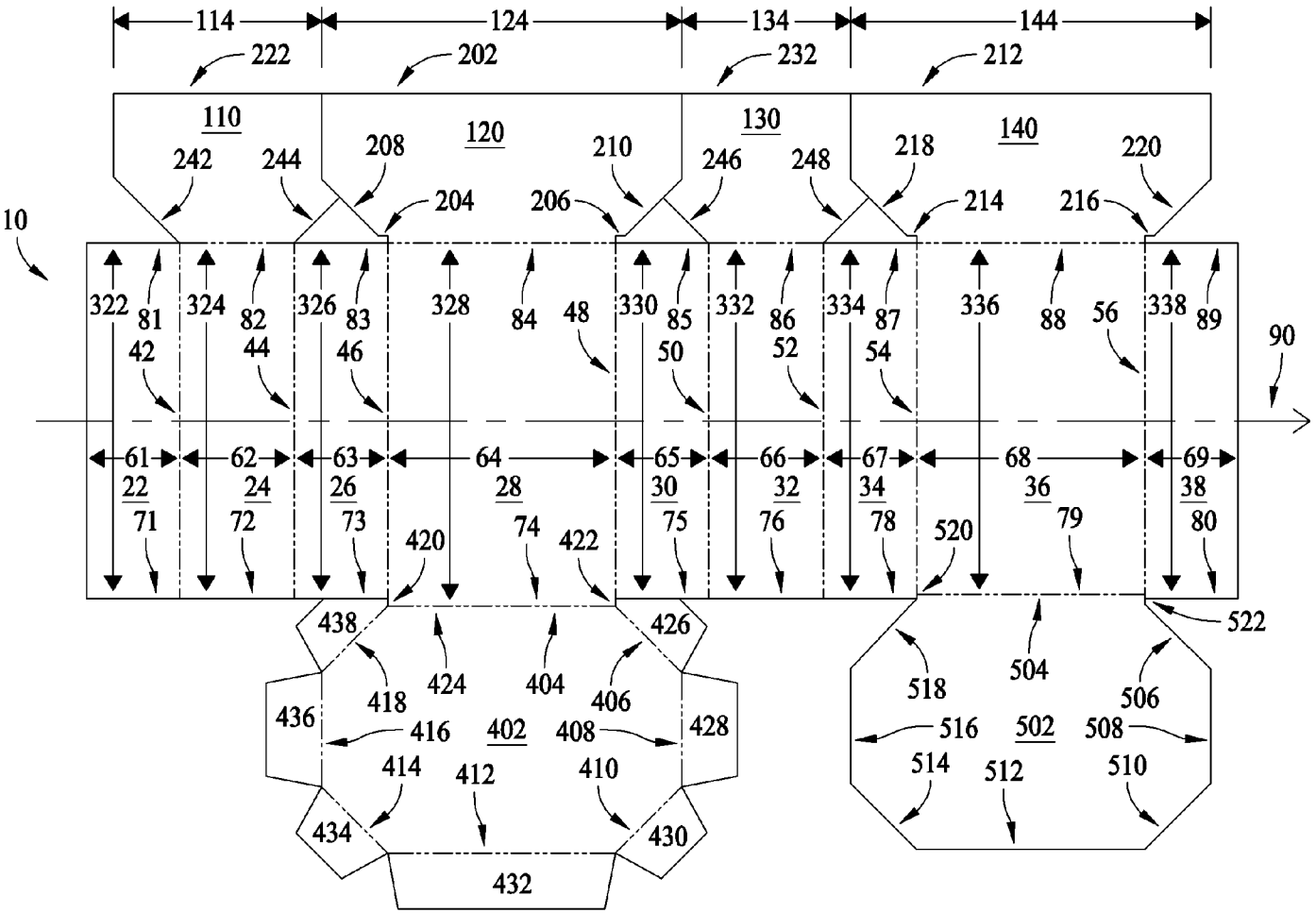
FIG. 1 is a top plan view of an exemplary embodiment of a blank of sheet material.
Figure 2:
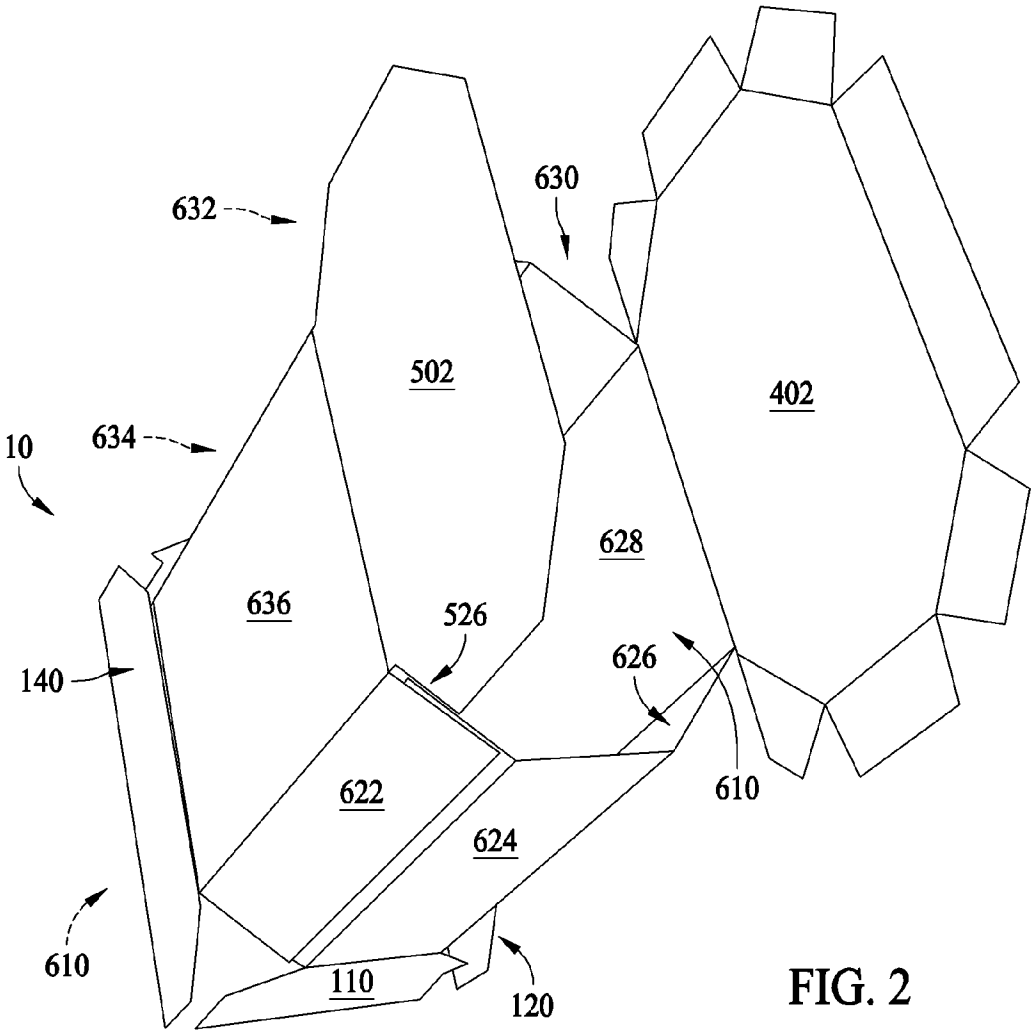
FIG. 2 is a perspective view of an exemplary embodiment of the blank from FIG. 1 as it is shaped into a container.
Figure 3:
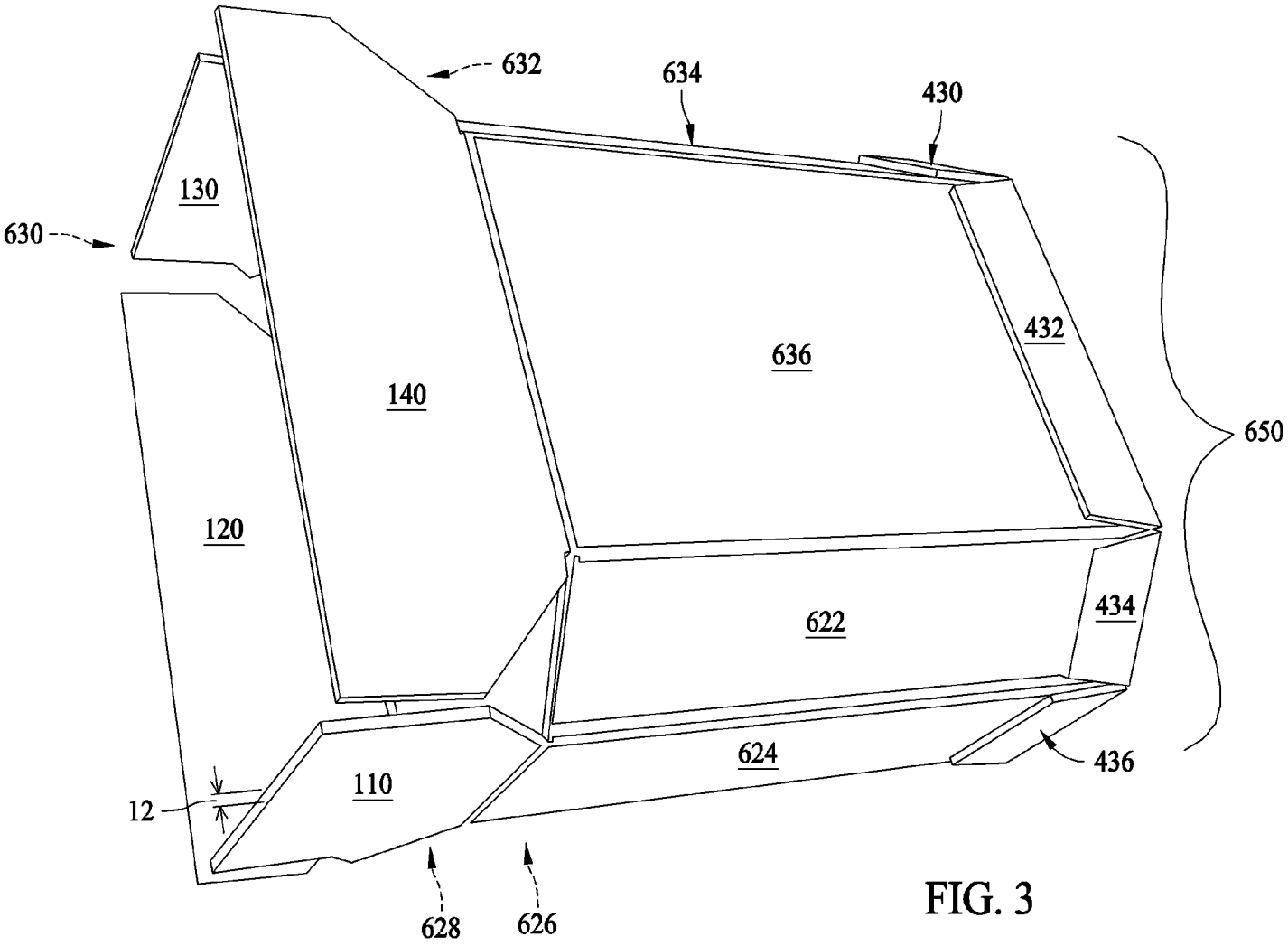
FIG. 3 is another perspective view of an exemplary embodiment of the blank from FIG. 1 as it is shaped into a container.

FIGS. 1-4 illustrate the formation of one embodiment of a container. As shown in FIG. 1, a blank of sheet material for forming a container is designated in its entirety by the reference numeral 10. Blank of sheet material 10 has a substantially uniform thickness 12 (as shown in FIG. 3). In one embodiment, blank 10 is made of paper board material. In an alternative embodiment, blank 10 is made of a cardboard, corrugated board, plastic, and/or any suitable material.

Blank 10 includes a plurality of panels. As shown in FIG. 1, blank 10 includes a succession of nine aligned rectangular panels 22, 24, 26, 28, 30, 32, 34, 36, 38. In this embodiment, panels 22, 38 are a first end panel and a second end panel, respectively. Panels 28, 36 are a first major panel and a second major panel, respectively. Panels 24, 32 are a first minor panel and a second minor panel, respectively. Panels 26, 30, 34 are a first intermediate panel, a second intermediate panel, and a third intermediate panel, respectively. Panels 22, 24, 26, 28, 30, 32, 34, 36, 38 are coupled together by a plurality of generally parallel fold lines 42, 44, 46, 48, 50, 52, 54, 56, respectively. In one embodiment, fold lines 42, 44, 46, 48, 50, 52, 54, 56 are preformed. As shown in FIG. 1, second end panel 38 extends from second major panel 36 along fold line 56; second major panel 36 extends from third intermediate panel 34 along fold line 54; third intermediate panel 34 extends from second minor panel 32 along fold line 52; second minor panel 32 extends from second intermediate panel 30 along fold line 50; second intermediate panel 30 extends from first major panel 28 along fold line 48; first major panel 28 extends from first intermediate panel 26 along fold line 46; first intermediate panel 26 extends from first minor panel 24 along fold line 44; and first minor panel 24 extends from first end panel 22 along fold line 42.

First end panel 22 has a width 61. Second end panel 38 has a width 69. Similarly, first intermediate panel 26 has a width 63; second intermediate panel 30 has a width 65; and third intermediate panel 34 has a width 67. Although end panels 22, 38 and intermediate panels 26, 30, 34 may have different widths without departing from the scope of the present invention, in the embodiment shown in FIG. 1 (and additionally an exemplary container 600 embodied in FIG. 4), widths 61, 63, 65, 67, 69 are substantially equal. Additionally, each minor panel 24, 32 has a respective width 62, 66. Although minor panels 24, 32 may have different widths without departing from the scope of the present invention, in the embodiment shown in FIG. 1 (and additionally the exemplary container 600 embodied in FIG. 4) widths 62, 66 are substantially equal. Further, each major panel 28, 36 has a respective width 64, 68. Although major panels 28, 36 may have different widths without departing from the scope of the present invention, in the embodiment shown in FIG. 1 (and additionally the exemplary container 600 embodied in FIG. 4) widths 64, 68 are substantially equal.

Furthermore, each panel 22, 24, 26, 28, 30, 32, 34, 36, 38 has a top edge 81, 82, 83, 84, 85, 86, 87, 88, 89, respectively. Top edges 81, 82, 83, 84, 85, 86, 87, 88, 89 are generally parallel to a horizontal axis 90 and are generally perpendicular to respective fold lines 42, 44, 46, 48, 50, 52, 54, and/or 56. Likewise, each panel 22, 24, 26, 28, 30, 32, 34, 36, 38 has a bottom edge 71, 72, 73, 74, 75, 76, 78, 79, 80 respectively. Bottom edges 71, 72, 73, 74, 75, 76, 78, 79, 80 are generally parallel to a horizontal axis 90 and are generally perpendicular to fold lines 42, 44, 46, 48, 50, 52, 54, and/or 56.

Each panel 22, 24, 26, 28, 30, 32, 34, 36, 38 has a length 322, 324, 326, 328, 330, 332, 334, 336, 338, respectively. Although end panels 22, 38, intermediate panels 26, 30, 34, and minor panels 24, 32 may have different lengths without departing from the scope of the present invention, in the embodiment shown in FIG. 1 (and additionally the exemplary container 600 embodied in FIG. 4), lengths 322, 338, 326, 330, 334, 324, 332 are substantially equal.

Compared to lengths 322, 324, 326, 328, 330, 332, 334, 336, 338, of panels 22, 24, 26, 28, 30, 32, 34, 36, 38, respectively, length 328 of first major panel 28 is slightly longer and length 336 of second major panel 36 is slightly shorter than panels 22, 24, 26, 30, 32, 34, 38. As is described below, this facilitates reducing gaps in a bottom of a constructed container by accommodating for the blank thickness.

Figure 4:
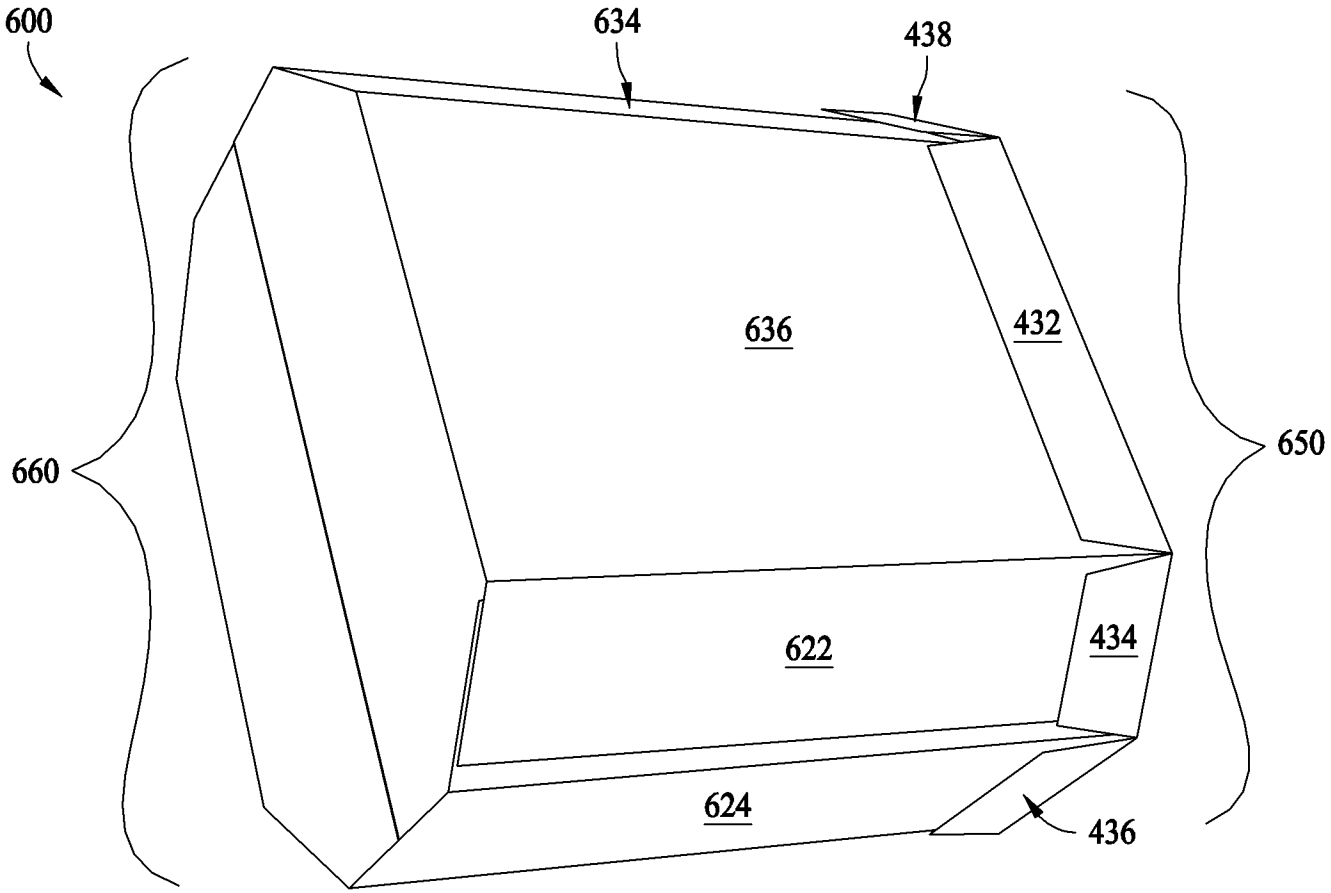
FIG. 4 is a perspective view of an exemplary embodiment of a container constructed from the blank from FIG. 1.

End panels 22, 38 at least partially overlap each other and are coupled or secured to each other by using a suitable coupling or securing mechanism, such as an adhesive material. It is apparent to those skilled in the art and guided by the teachings herein provided that any suitable coupling or securing mechanism may be used to couple or secure end panels 22, 38. Further, each end panel 22, 38 is obliquely angled to first minor panel 24 and second major panels 36. In one embodiment, as shown in FIGS. 2-4, end panel 38 overlaps end panel 22. In an alternative embodiment, end panel 22 overlaps end panel 38.

As shown in FIG. 2, panels 24, 26, 28, 30, 32, 34, 36 and overlapping coupled or secured end panels 22, 38 form sides 624, 626, 628, 630, 632, 634, 636, 622, respectively. In an embodiment, sides 622, 624, 626, 628, 630, 632, 634, 636 are obliquely angled to each other. In one embodiment, sides 622, 624, 626, 628, 630, 632, 634, 636 are angled at about 135° with respect to each other. However, it is apparent to those skilled in the art and guided by the teachings provided herein that other angles may be used for the present invention.

A cavity 610 (or void 610) is defined as the space circumscribed by sides 624, 626, 628, 630, 632, 634, 636, 622. Cavity 610 has a top and a bottom. Inner bottom flap 502 is folded such that inner bottom flap 502 is substantially perpendicular to panel 36 and at least partially covers the bottom of cavity 610. In one embodiment, side edges 506, 508, 510, 512, 514, 516, 518, 522 of inner bottom flap 502 contact a corresponding side 622, 624, 626, 628, 630, 632, 634, 636.

A minor cover flap 110 extends from first minor panel 24 along a fold line at top edge 82. A minor cover flap 130 extends from second minor panel 32 along a fold line at top edge 86. As shown in FIG. 1, first minor cover flap 110 has a length 114 taken along horizontal axis 90 of blank 10 that is greater than width 62 of first minor panel 24. Second minor cover flap 130 has a length 134 taken along horizontal axis 90 that is greater than width 66 of second minor panel 32.

A major cover flap 120 extends from first major panel 28 along a fold line at top edge 84. A major cover flap 140 extends from second major panel 36 along a fold line at top edge 88. First major cover flap 120 has a length 124 taken along horizontal axis 90 that is greater than width 64 of first major panel 28. Second major cover flap 140 has a length 144 taken along horizontal axis 90 that is greater than width 68 of second major panel 36.

Specifically, each major cover flap 120, 140 includes an outer edge 202, 212, respectively, defining a perimeter of cover flap 120, 140. As shown in FIG. 1, as outer edge 202 transitions into fold line 46, outer edge 202 forms a first notch 204. Notch 204 generally extends from fold line 46, but it is within the scope of the present invention for notch 204 to extend from major panel 28. In one embodiment, notch 204 runs generally along or parallel to fold line 46, and turns to extend generally parallel or slightly obliquely to top edge 83. Notch 204 then transitions into outer edge 202 at a portion 208 that extends more obliquely than notch 204. Likewise, as outer edge 202 generally transitions into fold line 48, outer edge 202 forms a second notch 206. Notch 206 generally extends from fold line 48, but it is within the scope of the present invention for notch 206 to extend from major panel 28. In this embodiment, notch 206 extends generally along or parallel to fold line 48, then turns to extend generally parallel or slightly obliquely to top edge 85. Notch 206 then transitions into outer edge 202 at a portion 210 that extends more obliquely than notch 206.

Similarly, as outer edge 212 transitions into fold line 54, outer edge 212 forms a first notch 214. Notch 214 generally extends from fold line 54, but it is within the scope of the present invention for notch 214 to extend from major panel 36. In one embodiment, notch 214 runs generally along or parallel to fold line 54, and turns to extend generally parallel or slightly obliquely to top edge 87. Notch 214 then transitions into outer edge 212 at a portion 218 that extends more obliquely than notch 214. Likewise, as outer edge 212 generally transitions into fold line 56, outer edge 212 forms a second notch 216. Notch 216 generally extends from fold line 56, but it is within the scope of the present invention for notch 216 to extend from major panel 36 In this embodiment, notch 216 extends generally along or parallel to fold line 56, then turns to extend generally parallel or slightly obliquely to top edge 89. Notch 216 then transitions into outer edge 212 at a portion 220 that extends more obliquely than notch 216.

In one embodiment, major cover flaps 120, 140 along with notches 204, 206, 214, 216 at least partially cover cavity 610 as well as sides 624, 626, 628, 630, 632, 634, 636, 622. In an alternative embodiment, major cover flaps 120, 140 along with notches 204, 206, 214, 216 at least cover cavity 610 as well as the thickness of sides 624, 626, 628, 630, 632, 634, 636, 622.

Each minor cover flap 110, 130 includes an outer edge, 222, 232 respectively, defining a perimeter of minor cover flap 110, 130. As shown in FIG. 1, outer edge 222 is partially defined by outer edge 202 of first major cover flap 120. Similarly, outer edge 232 is partially defined by outer edge 202 of first major cover flap 120 and by outer edge 212 of second major cover flap 140. In one embodiment (and in exemplary container 600 of FIG. 4), major cover flaps 120, 140 at least partially cover the top of container 600, including the widths of the panels. In alternative embodiments, major cover flaps 120, 140 have any suitable or desired size and/or shape.

Outer edge 222 of first minor cover flap 110 includes a pair of opposite portions 242, 244 that are each obliquely angled with respect to top edge 82. In one embodiment, portions 242, 244 are angled at about 45° with respect to top edge 82. Similarly, outer edge 232 of second minor cover flap 130 includes a pair of opposite portions 246, 248 that are each obliquely angled with respect to top edge 86. In one embodiment, portions 246, 248 are angled at about 45° with respect to top edge 86. It is apparent to those skilled in the art and guided by the teachings herein provided that portions 242, 244 may be angled with respect to top edge 82 at any suitable angle, and that portions 246, 248 may be angled with respect to top edge 86 at any suitable angle, such that portions 242, 244, 246, 248 contact respective panels when container 600 is constructed.

FIG. 1 also illustrates an outer bottom flap 402 coupled to first major panel 28 along a fold line. An inner bottom flap 502 couples to second major panel 36 along a fold line. When folded along their respective fold lines, outer bottom flap 402 and inner bottom flap 502 form a bottom 650. As will be described in more detail below, the shape, size, and/or arrangement of bottom flaps 402, 502, and cover flaps 110, 120, 130, 140, as shown in FIG. 1 and described above, facilitates constructing a container 600 having angled corners as shown in FIG. 4. More specifically, the shape, size, and/or arrangement of outer bottom flap 402, inner bottom flap 502, and cover flaps 110, 120, 130, 140 facilitates forming a container having panels 22, 24, 26, 28, 30, 32, 34, 36, 38 that are obliquely angled with respect to adjacent panels.

Side edges 404, 406, 408, 410, 412, 414, 416, 418 define a periphery of outer bottom flap 402. Side edges 404, 406, 408, 410, 412, 414, 416, 418 form angled corners with respect to the adjacent side edges.

Outer bottom flap 402 includes flanges 426, 428, 430, 432, 434, 436, 438 that extend from respective fold lines of outer bottom flap 402. In one embodiment (and in exemplary container 600 shown in FIG. 4), each flange 426, 428, 430, 432, 434, 436, 438 is a quadrilateral with each fold line parallel to the opposing side. It is apparent to those skilled in the art and guided by the teaching herein provided that there a variety of shapes and sizes suitable for flanges 426, 428, 430, 432, 434, 436, 438.

A first niche 420 and a second niche 422 further define outer bottom flap 402. First niche 420 is defined by side edges 418, 404, fold line 46, and bottom edge 73. Second niche 422 is defined by side edges 404, 406, fold line 48, and bottom edge 75. Niches 420, 422 facilitate reducing gaps in a container of the present invention by accommodating for blank thickness 12 so that flanges 426, 428, 430, 432, 434, 436, 438 can couple to a respective exterior of sides 630, 632, 634, 636, 622, 624, 626.

Inner bottom flap 502 includes a plurality of side edges 504, 506, 508, 510, 512, 514, 516, 518, 522 that define a periphery of inner bottom flap 502. Each side edge 504, 506, 508, 510, 512, 514, 516, 518, 522 has a length. Side edge 522 extends from fold line 56 and is perpendicular to side edge 504 and bottom edge 79. Side edge 522 forms an angled corner with respect to side edge 506. Length of side edge 522 is shorter than the remaining side edges of inner bottom flap 502. In one embodiment, the length of side edge 522 allows for the overlapping of end panels 38, 22 when a container is constructed from the present invention. More specifically, the length of side edge 522 is substantially equal to the thickness of blank 10. However, it is apparent to those skilled in the art and guided by the teachings herein provided that many suitable lengths for side edge 522 exist.

In one embodiment, inner bottom flap 502 has an indentation 520 that is defined as the general area where side edges 518, 504, bottom edge 77, and fold line 54 terminate. In one embodiment, indentation 520 accommodates for the thickness of inner bottom flap 502 when a container is constructed from the present invention. In another embodiment, indentation 520 has a length that is the difference between length 36 and length 34. For purposes of this invention, it is apparent to those skilled in the art and guided by the teachings herein provided that many suitable arrangements can facilitate constructing a container from the present invention.

Lengths of side edges 508, 510, 512, 514, 516, 518 are slightly less than widths 62, 63, 64, 65, 66, 67, respectively, in order to allow a folded inner bottom flap 502 to nest within sides 622, 624, 626, 628, 630, 632, 634, 636 after panels 22, 24, 26, 28, 30, 32, 36, 38 are folded about respective fold lines 42, 44, 46, 48, 50, 52, 54, 56 to form a container. In one embodiment, inner bottom flap 502 contacts some of panels 22, 24, 26, 28, 30, 32, 34, 36, 38. In an alternative embodiment, inner bottom flap 502 contacts each side 622, 624, 626, 628, 630, 632, 634, 636 at least partially. As is described below, accommodating for the thickness and angle of side 622, 624, 626, 628, 630, 632, 634, 636 facilitates reducing gaps at the bottom of a formed container.

As is shown in FIGS. 1 and 2, length of side edge 506 may be slightly greater than width 61. However, it is apparent to those skilled in the art and the teachings provided herein that length of side edge 506 may be equal to or slightly less than width 61 or width 69.

Referring to outer bottom flap 402 (shown in FIG. 1) each length of side edges 406, 408, 410, 412, 416, 418 is slightly greater than a corresponding width 65, 66, 67, 68, 62, 63, respectively, in order to accommodate for panels 30, 32, 34, 36, 24, 26 when the panels are folded about respective fold lines 48, 50, 52, 54, 56, 42, 44, 46 to construct a container. Similarly, length of side edge 414 is slightly greater than the resulting length of overlapping end panels 22, 38, when the end panels are secured together in a container.

As will be described below in more detail with reference to FIGS. 5-21, blank 10 is intended to form a container as shown in FIGS. 3-4 (an exemplary embodiment 600) by wrapping, coupling, and/or securing panels 22, 24, 26, 28, 30, 32, 34, 36, 38, bottom flaps 402, 502, and cover flaps 110, 120, 130, 140. In one embodiment, the panels and flaps are wrapped, coupled, and/or secured in order to reduce gaps in a container. Furthermore, it is apparent that those skilled in the art and from the teachings provided herein that blanks may have any suitable shape, size, and/or configuration.

As shown in FIG. 3, to construct a bottom 650 of container 600, after end panels 22, 38 are secured to form cavity 610, as described above, inner bottom flap 502 and outer bottom flap 402 are folded along respective fold lines. Inner bottom flap 502 at least partially covers cavity 610 (and positioned adjacent to cavity 610) and nests within sides 622, 624, 626, 628, 630, 632, 634, 636. Outer bottom flap 402 is positioned adjacent to inner bottom flap 502 in a face-to-face relationship and at least partially covers inner bottom flap 502. In one embodiment, outer bottom flap also at least partially covers a thickness of sides 622, 624, 626, 628, 630, 632, 634, 636. In one embodiment, outer bottom flap completely covers inner bottom flap 502 and the thickness of sides 622, 624, 626, 628, 630, 632, 634, 636. In another embodiment, bottom flaps 402, 502 are generally perpendicular to sides 622, 624, 626, 628, 630, 632, 634, 636. It is apparent to those skilled in the art and guided by the teachings provided herein that many arrangements, shapes, and/or sizes exist for outer bottom flap 402 to at least partially cover inner bottom flap 502 and the thickness of sides 622, 624, 626, 628, 630, 632, 634, 636.

Outer bottom flap 402 is coupled or secured to inner bottom flap 502. In one embodiment, outer bottom flap 402 is coupled or secured to inner bottom flap 502 by an adhesive material. In alternative embodiments, any suitable coupling material and/or mechanism may be used to couple or secure outer bottom flap 402 to inner bottom flap 502.

FIG. 4 shows flanges 426, 428, 430, 432, 434, 436, 438 that are coupled or secured to the outer surface of sides 622, 624, 626, 628, 630, 632, 634, 636. In one embodiment, flanges 426, 428, 430, 432, 434, 436, 438 are coupled or secured to the outer surface of sides 622, 624, 626, 628, 630, 632, 634, 636 by an adhesive material. In alternative embodiments, any suitable coupling material and/or mechanism may be used to couple or secure flanges 426, 428, 430, 432, 434, 436, 438 to sides 622, 624, 626, 628, 630, 632, 634, 636.

As shown in FIGS. 2 and 3, to form a top 660 cover flaps 110, 120, 130, 140 fold along corresponding fold lines to at least partially cover cavity 610 in container 600. In one embodiment, minor cover flaps 110, 130 first fold along their corresponding fold lines, followed by major cover flaps 120, 140 folding along their corresponding fold lines. In other embodiments, outer edges 202, 212 of the respective folded major cover flaps 120, 140 contact each other, nearly contact each other, or at least partially overlap each other. In another embodiment, cover flaps 110, 120, 130, 140 are generally perpendicular to sides 622, 624, 626, 628, 630, 632, 634, 636. Furthermore, it is apparent that those skilled in the art and guided by the teachings provided herein that many arrangements exist for cover flaps 110, 120, 130, 140 to form top 660.

A method for constructing container 600 from a blank, such as blank 10 described above, is also provided. In one embodiment, the method includes providing blank 10 having panels 22, 24, 26, 28, 30, 32, 34, 36, 38 coupled together along corresponding, generally parallel, fold lines 42, 44, 46, 48, 50, 52, 54, 56. Outer bottom flap 402 is coupled to first major panel 28. Flanges 426, 428, 430, 432, 434, 436, 438 are coupled to outer bottom flap 402. Inner bottom flap 502 is coupled to second major panel 36.

First end panel 22 is coupled to second end panel 38 to form a plurality of sides 622, 624, 626, 628, 630, 632, 634, 636 defining a cavity within. Inner bottom flap 502 is folded such that side edges 504, 506, 508, 510, 512, 514, 516, 518, 522 contact the interior of sides 622, 624, 626, 628, 630, 632, 634, 636. Outer bottom flap 402 is folded and each flange 426, 428, 430, 432, 434, 436, 438 is coupled or secured to a corresponding side 622, 624, 626, 630, 632, 634, 636.

First major cover flap 120 is coupled to first major panel 28. A second major cover flap 140 is coupled to second major panel 36. First minor cover flap 110 is coupled to first minor panel 24. A second minor cover flap 130 is coupled to second minor panel 32. First minor cover flap 110, second minor cover flap 130, first major cover flap 120, and second major cover flap 140 are folded such that the cover flaps are generally perpendicular to sides 622, 624, 626, 628, 630, 632, 634, 636.

Figure 5:
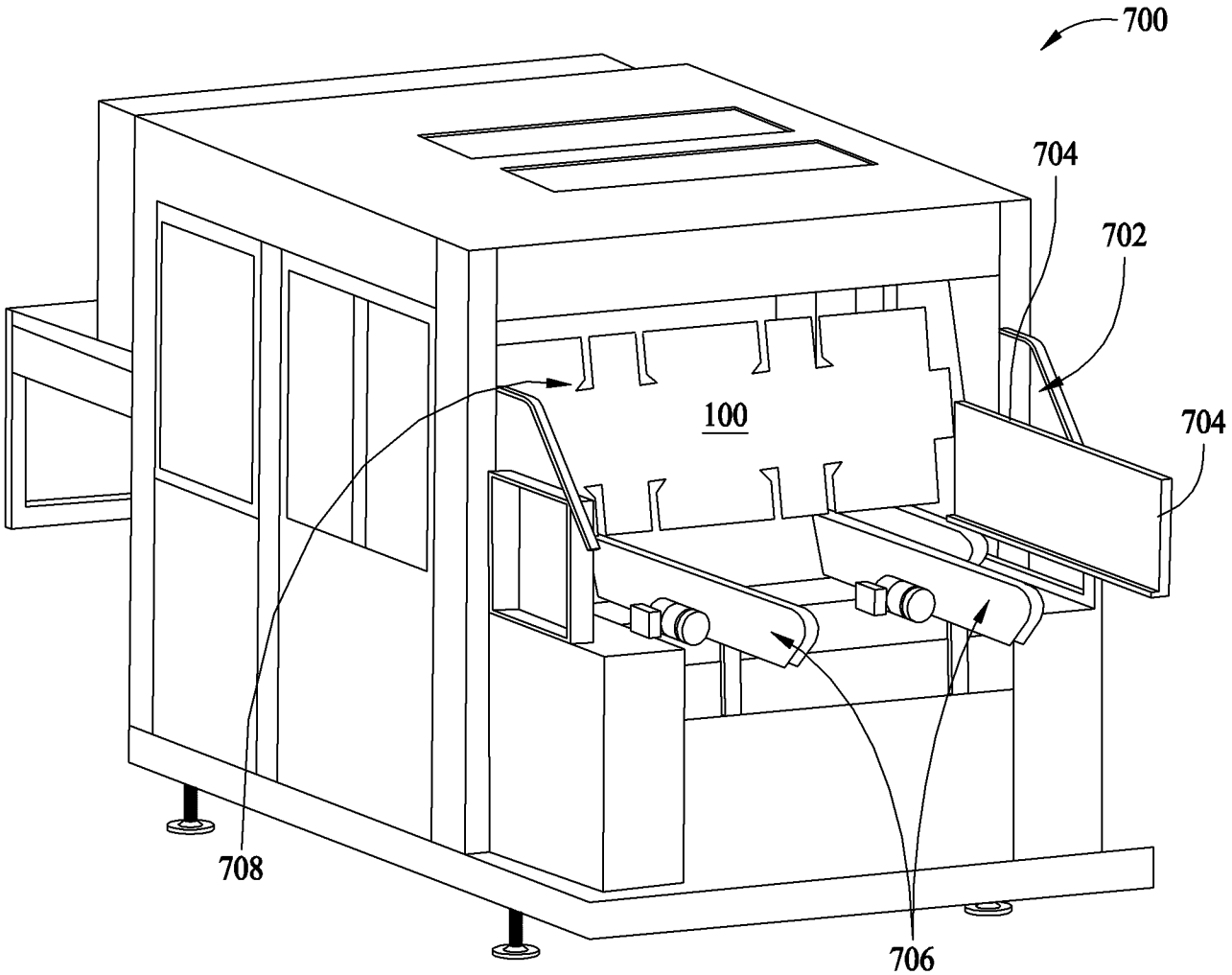
FIG. 5 is a perspective view of an exemplary embodiment of a machine that may be used to form a container from the blank of sheet material shown in FIG. 1.

FIG. 5 illustrates a machine 700 for forming a container (e.g., the container 600 shown in FIG. 4) from a blank of sheet material 100. Blank sheet of material 100 can be blank 10 as described above. Machine 700 will be discussed hereafter with reference to forming container 600 from blank 100. However, machine 700 may be used to form a container having any size, shape, or configuration from a blank having any size, shape, or configuration without departing from the scope of the present invention.

Figure 6:
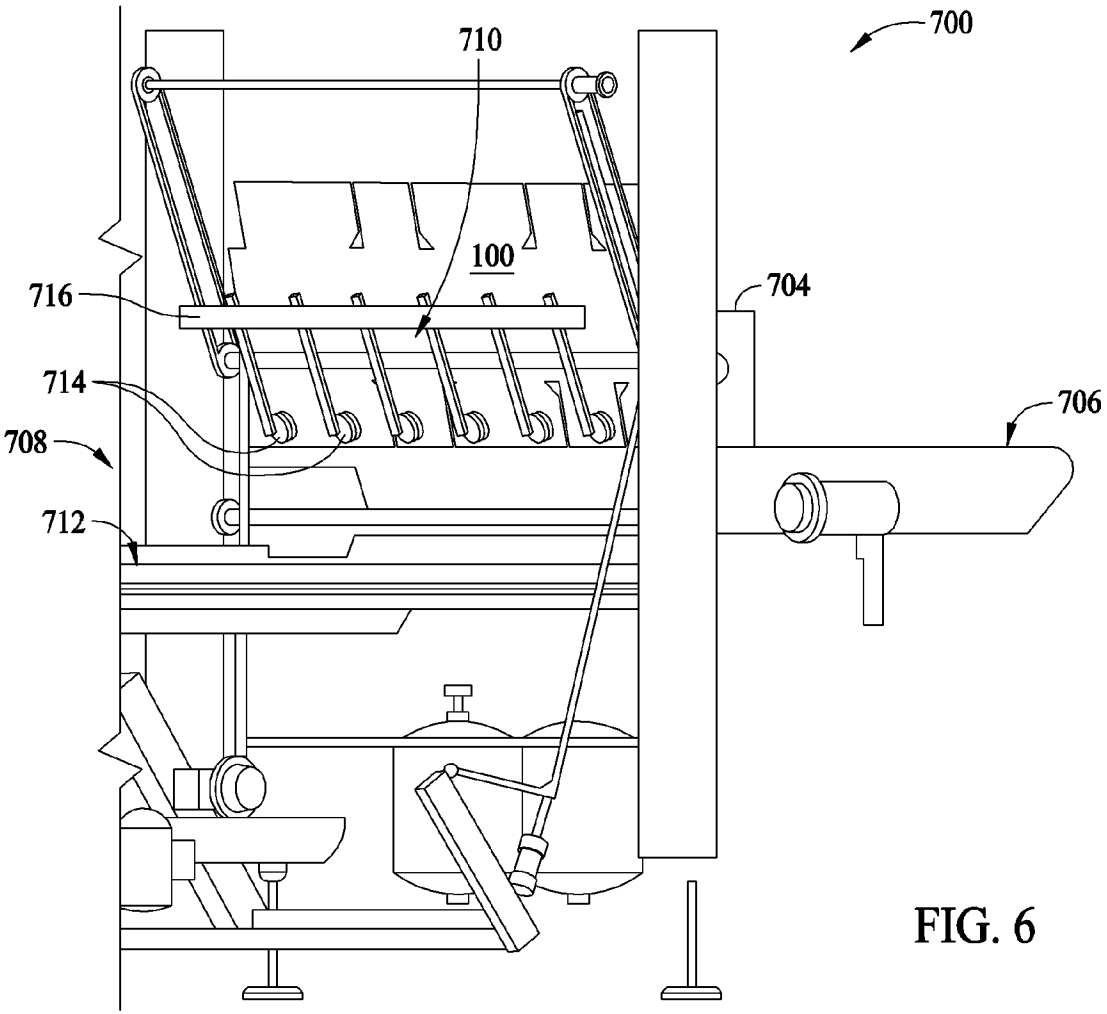
FIG. 6 is a perspective view of a portion of the machine shown in FIG. 5.
Figure 7:
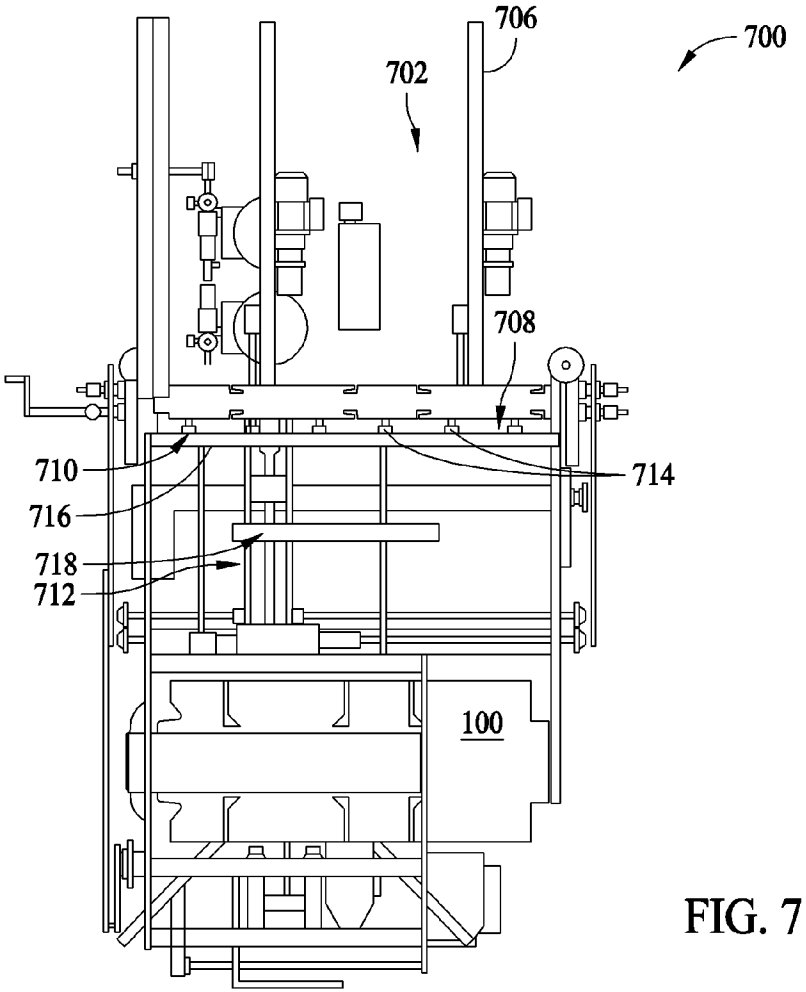
FIG. 7 is a top view of the machine shown in FIG. 5.

Machine 700 includes a loading section 702 for loading blanks into the machine for formation into containers. Specifically, blank 100 is loaded into a loading frame 704 that supports the blank in a generally vertical position. A conveyor 706 moves blank 100 into a transfer section 708 as loading frame 704 supports the blank. As shown in FIGS. 6 and 7, a gripping member 710 attaches to blank 100 and lifts the blank out of loading frame 704 and places the blank onto a support 712 in a generally horizontal position. Although any suitable gripping mechanism, structure, and/or means may be used to attach to blank 100 and lift the blank out of loading frame 704 and onto support 712 without departing from the scope of the present invention, in one embodiment gripping member 710 includes a plurality of vacuum cups 714 connected to a rotating frame 716. Vacuum cups 714 attach to blank 100 and grip the blank as the rotating frame 716 positions the blank over support 712 in front of a pusher assembly 718 (shown in FIG. 7). Vacuum cups 714 then release their grip to place the blank onto support 712.

Figure 8:
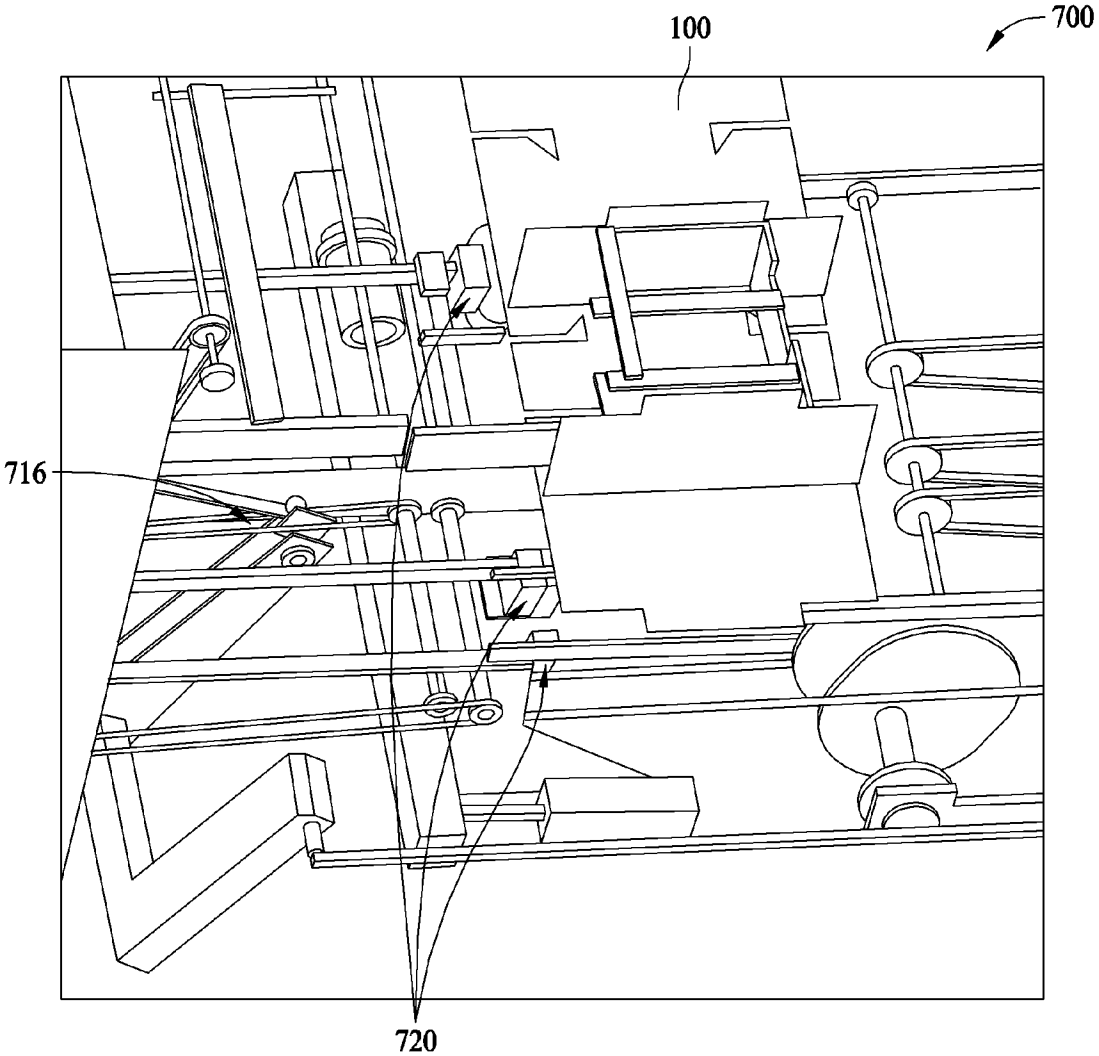
FIG. 8 is a perspective view of a portion of the machine shown in FIG. 5.
Figure 9:
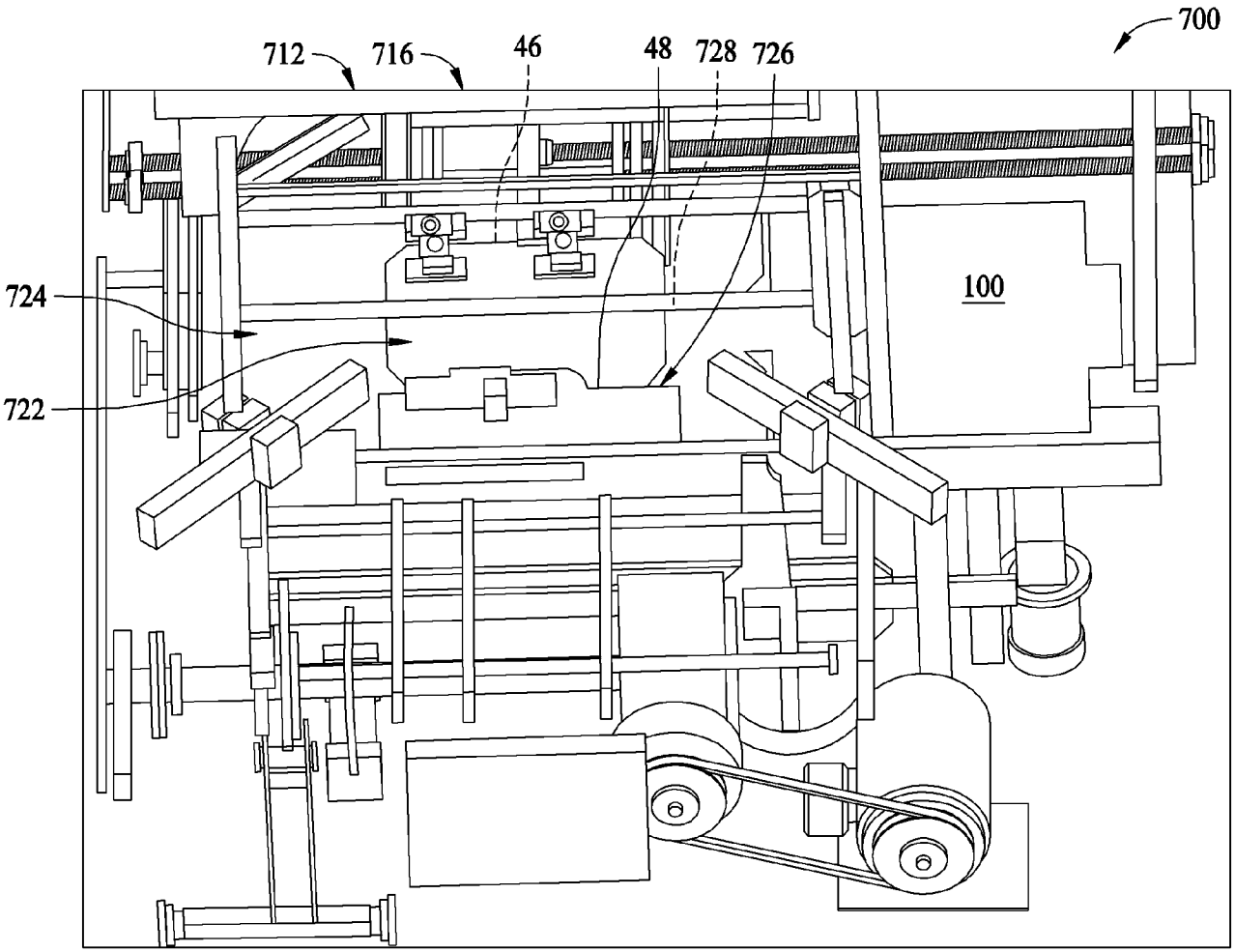
FIG. 9 is another perspective view of a portion of the machine shown in FIG. 5.
Figure 11:
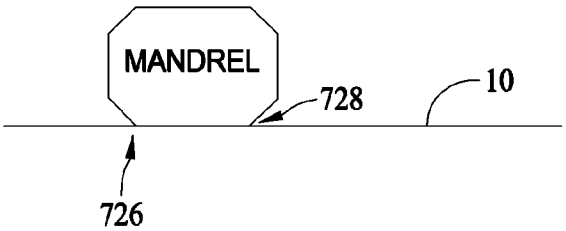
FIG. 11 is a cross section of an exemplary embodiment of a mandrel used in the machine shown in FIG. 5 and illustrating the blank shown in FIG. 1 wrapped partially therearound.
Figure 13:
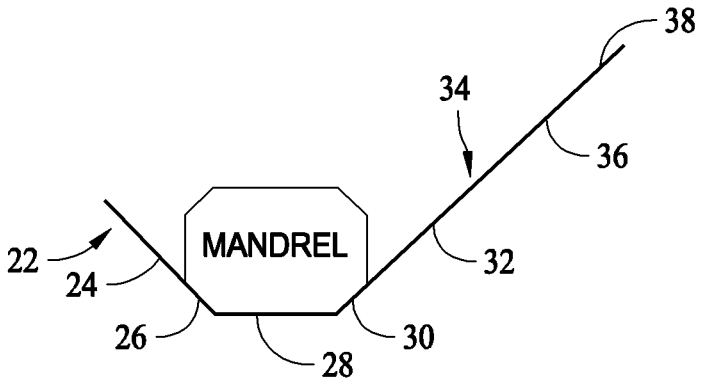
FIG. 13 is a cross section of the mandrel of the machine shown in FIG. 5 and illustrating the blank shown in FIG. 1 wrapped partially therearound.
Figure 14:
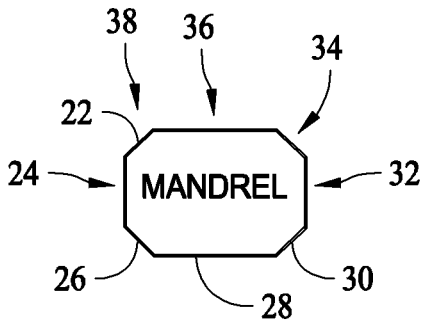
FIG. 14 is a cross section of the mandrel of the machine shown in FIG. 5 illustrating the blank shown in FIG. 1 wrapped therearound.

As shown in FIG. 8, pusher assembly 716 pushes the blank 100 over hot melt glue guns 720 where adhesive is applied to surfaces (not shown) of first end panel 22 and/or second end panel 38, inner bottom flap 502 and/or outer bottom flap 402. Furthermore, in some embodiments, adhesive is applied to surfaces of flanges 426, 428, 430, 432, 434, 436, 438. FIG. 9 illustrates pusher assembly 716 as it guides the blank 100 along support 712 until the blank is underneath an internal mandrel 722 mounted on a body 724 of machine 700. Mandrel 722 is defined by a plurality of side walls substantially circumscribing a horizontal axis (not shown) extending through a center of mandrel 722. FIGS. 11, 13, and 14 show that mandrel 722 has an external shape that is complimentary to at least a portion of an internal shape of container 600 formed from blank 100. In one embodiment, mandrel 722 includes side walls that are substantially parallel to the central horizontal axis.

Pusher assembly 716 pushes blank 100 along support 712 such that first major panel 28 is positioned underneath mandrel 722 and fold lines 46, 48 of respective first major panel are aligned with respective outer edges 726, 728 of the mandrel (shown in FIG. 11).

It is apparent to those skilled in the art and guided by the teachings provided herein that other arrangements of blank 100 with mandrel 722 are within the scope of this invention. For example, second major panel 36 can be positioned underneath mandrel 722 and fold lines 54, 56 of respective second major panel aligned with outer edges of mandrel 722.

Figure 10:
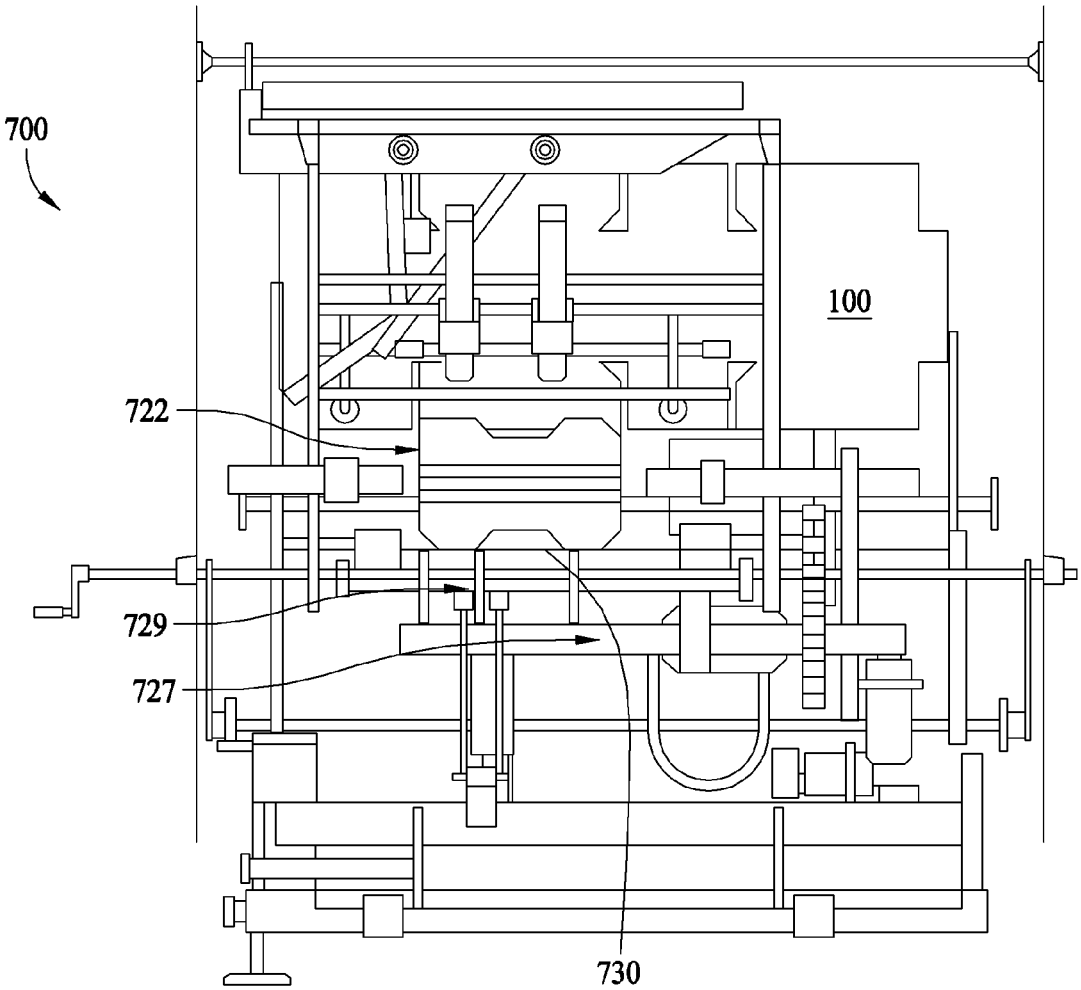
FIG. 10 is a front elevation view of the machine shown in FIG. 5.
Figure 12:
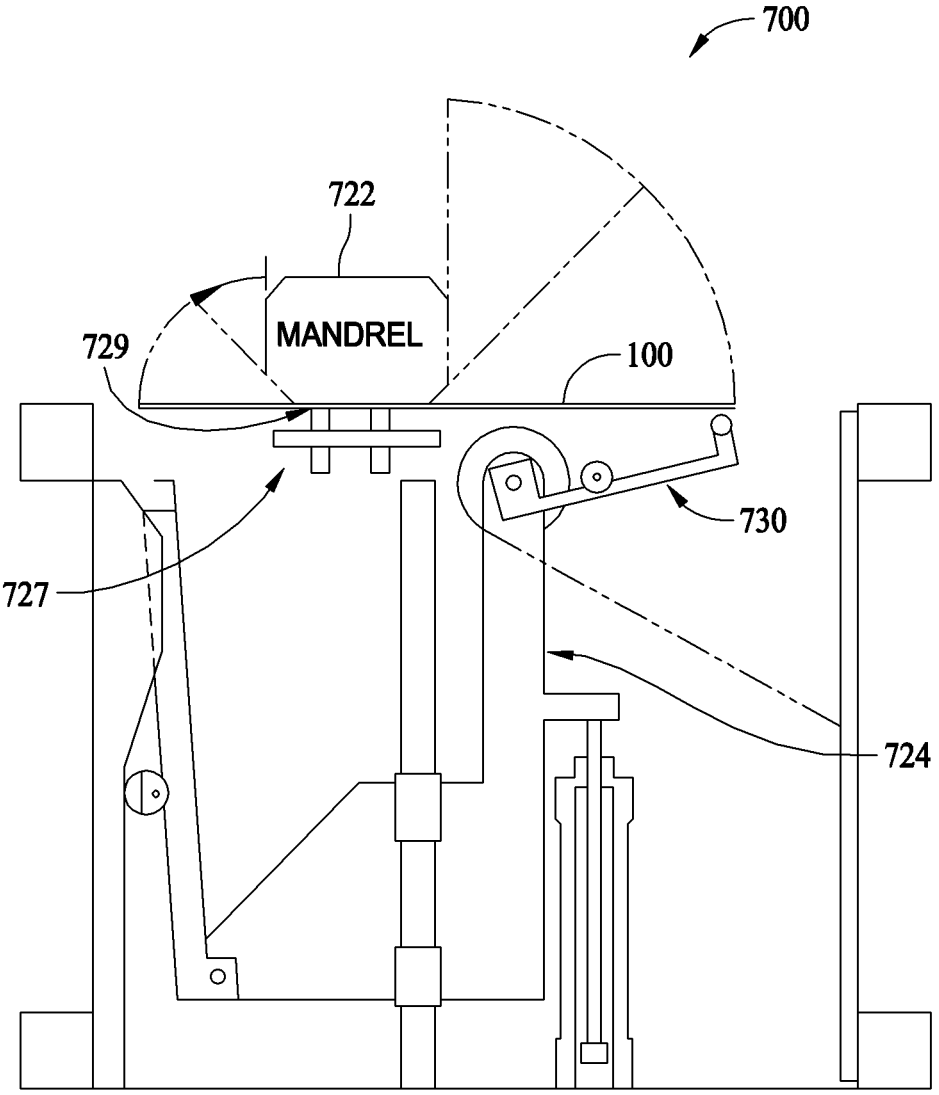
FIG. 12 is a schematic of a portion of the machine shown in FIG. 5.

As shown in FIG. 10, a lifting assembly 727 lifts blank 100 off support 712 and pushes first major panel 28 tight against mandrel 722. More specifically, a member 729 and sometimes referred to as a pressure plate member of lifting assembly 727 engages first major panel 28 and pushes the back of the panel tight against mandrel 722. FIG. 11 generally illustrates the position of blank 100 with respect to mandrel 722 after member 729 engages first major panel 28. As shown in FIGS. 12-14, a member 730 of machine 700 engages panels 22, 24, 26, 30, 32, 34, 36, 38 and wraps the panels around mandrel 722. Although any suitably configured member may be used to wrap panels 22, 24, 26, 30, 32, 34, 36, 38 around mandrel 722 without departing from the scope of the present invention, in the exemplary embodiment member 730 is an arm rotatably mounted to machine body 724. FIGS. 13 and 14 generally illustrate blank 100 as wrapped around mandrel 722.

Also shown in FIG. 13, end panels 22, 38 overlap and are pressed tightly against mandrel 722. In one embodiment, end panel 38 overlaps end panel 22 and is pressed tightly against mandrel 722. In another embodiment, end panel 22 overlaps end panel 38 and is pressed tightly against mandrel 722.

Figure 15:
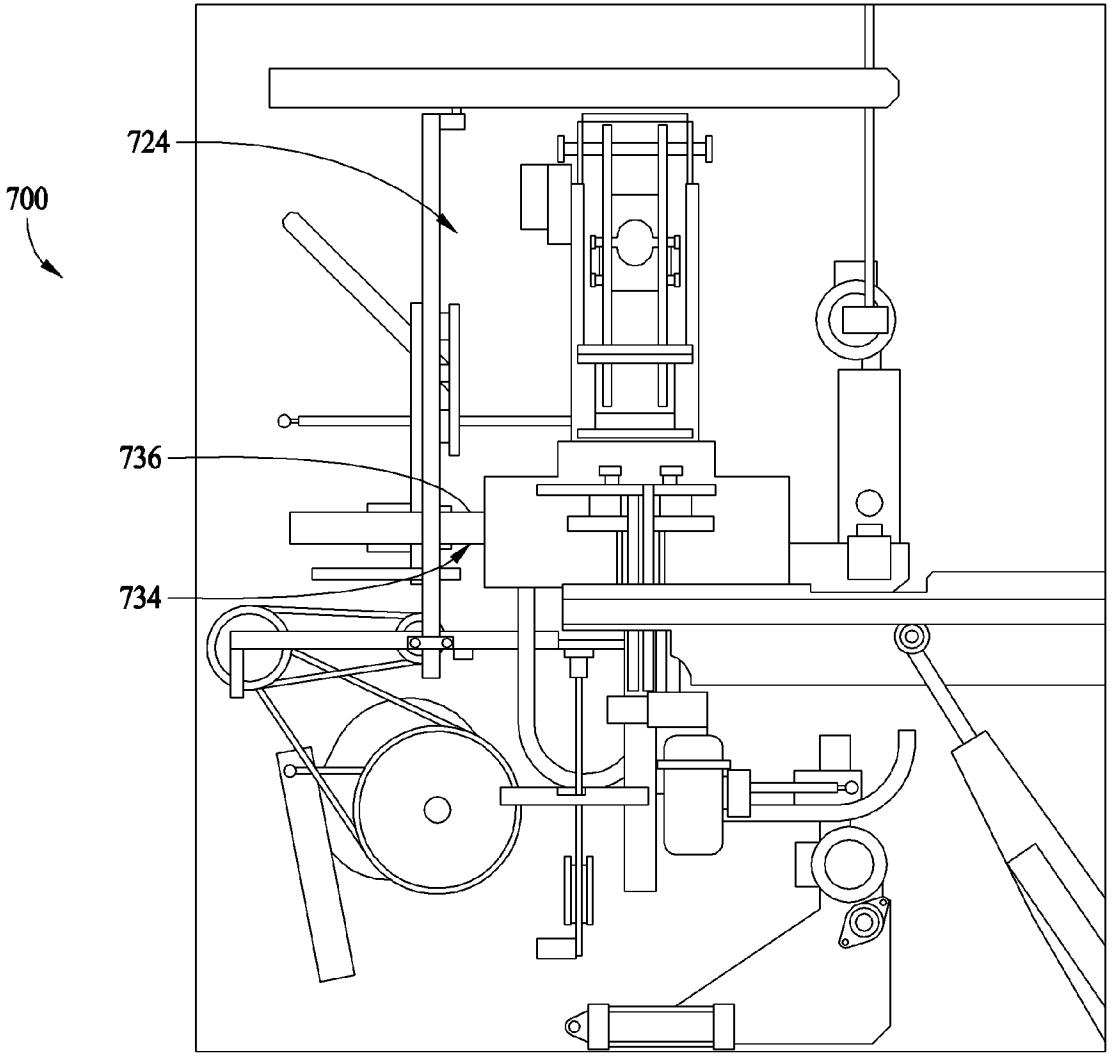
FIG. 15 is a side elevation of a portion of the machine shown in FIG. 5.

Machine 700 includes a bottom member including a flap folder element 734 and a bottom presser element 776 for forming bottom 650 of the container. FIG. 15 shows a flap folder element 734, which folds inner bottom flap 502 tight against mandrel 722. More specifically, flap folder element 734 is movably mounted to body 724 and an end 736 of flap folder element 734 engages and folds inner bottom flap 502 along its respective fold line and against mandrel 722.

Figure 16:
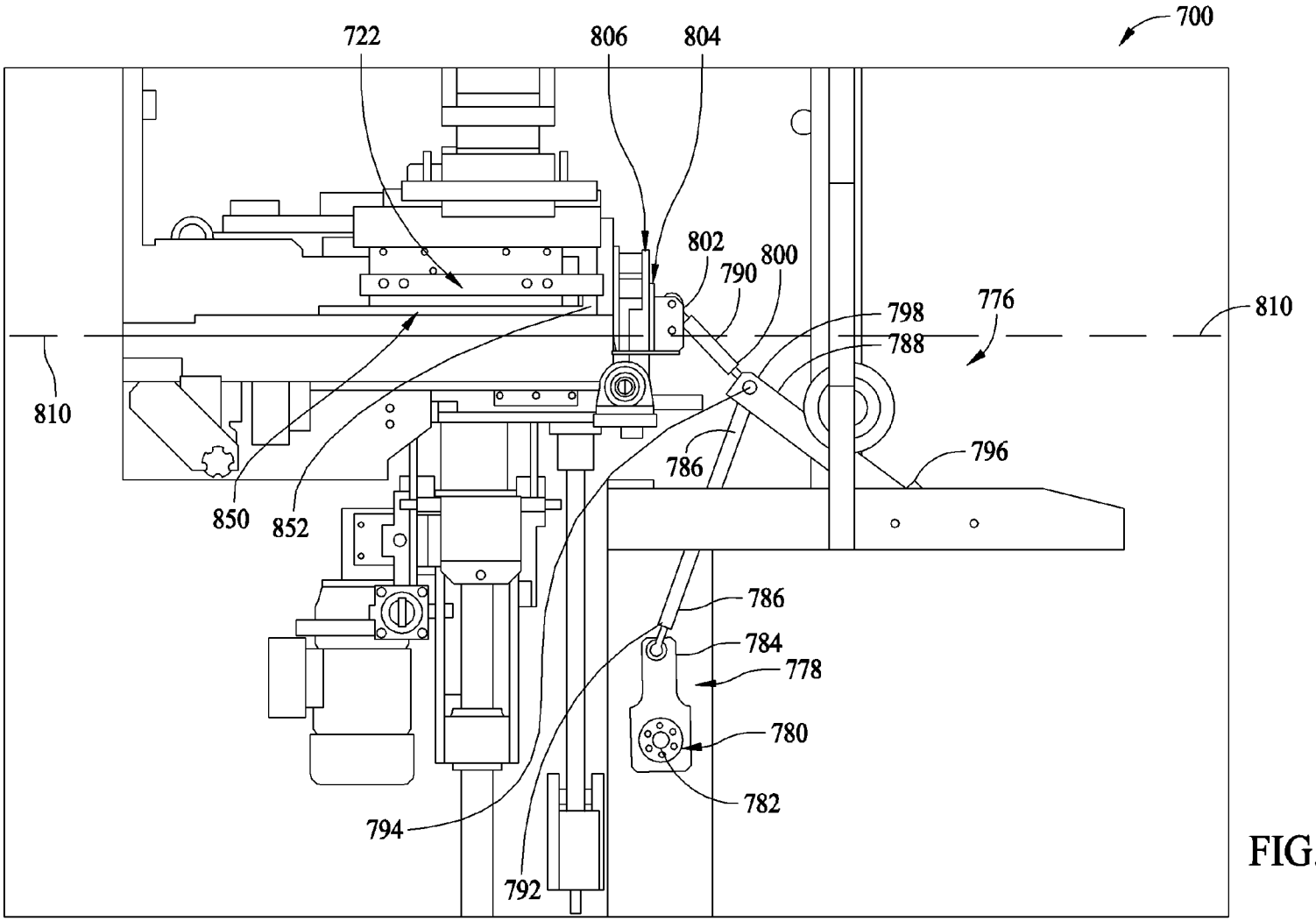
FIG. 16 is a side elevation of a portion of the machine shown in FIG. 5.

Once inner bottom flap 502 has been folded tight against mandrel 722, outer bottom flap 402 is folded tight and secured to mandrel 722. Specifically, as shown in FIG. 16 machine 700 includes a bottom presser element 776 mounted on body 724 adjacent mandrel 722 for folding outer bottom flap 402 about fold line 404. Bottom presser element 776 includes a servomechanism 778 for driving and controlling movement of member 776. In one embodiment, servomechanism 778 includes an electric motor 780 having an output shaft 782. Bottom presser element 776 may have include suitable structure and/or arrangement and/or configuration of such structure for providing a pressing component 804 be selectively positionable, sometimes referred to as toggled, between a first position 806 and a second position 808 (shown in FIG. 17). For example, in an exemplary embodiment as shown in FIG. 16, bottom presser element 776 includes a first link 784 connected to output shaft 782 for rotation with the shaft, a second link 786, a third link 788, and a fourth link 790. Second link 786 has a first end 792 rotatably connected to first link 784 and a second end 794 opposite the first end. Third link 788 has a first end 796 rotatably mounted on body 724 and a second end 798 opposite the first end. Second end 798 of third link 788 is rotatably connected to second end 794 of second link 786. Fourth link 790 has a first end 800 rotatably connected to second end 794 of second link 786 and second end 798 of third link 788. A second end 802 of fourth link 790 is connected to pressing component 804.

Pressing component 804 is selectably positionable, sometimes referred to as toggled, between a first position 808 (shown in FIG. 17) wherein pressing component 804 does not apply a force to the blank, and a second position 806 (shown in FIG. 16) wherein the pressing component applies a force to outer bottom flap 402 to compress adhesive between inner bottom flap 502 and outer bottom flap 402. Specifically, rotation of output shaft 782 of motor 780 causes relative movement between first, second, third, and fourth links 784, 786, 788, 790, respectively, to move pressing component 804 between first position 806 and second position 808. Although other ranges of movement may be used without departing from the scope of the present invention, in one embodiment first and second positions 806, 808, respectively, are separated by between about 70° and 90° of rotation. Moreover, although other ranges of movement may be used without departing from the scope of the present invention, in one embodiment output shaft 782 of electric motor 780 rotates between about 180° and 240° between first position 806 of pressing component and second position 808.

After outer bottom flap 402 is secured to inner bottom flap 502 as discussed above, a flange sealing mechanism is used to secure flanges 426, 428, 430, 432, 434, 436, 438 to respective sides 634, 636, 622, 624, 626, 630, 632. At least two mechanisms can be used for the flange sealing mechanism.

Figure 18:
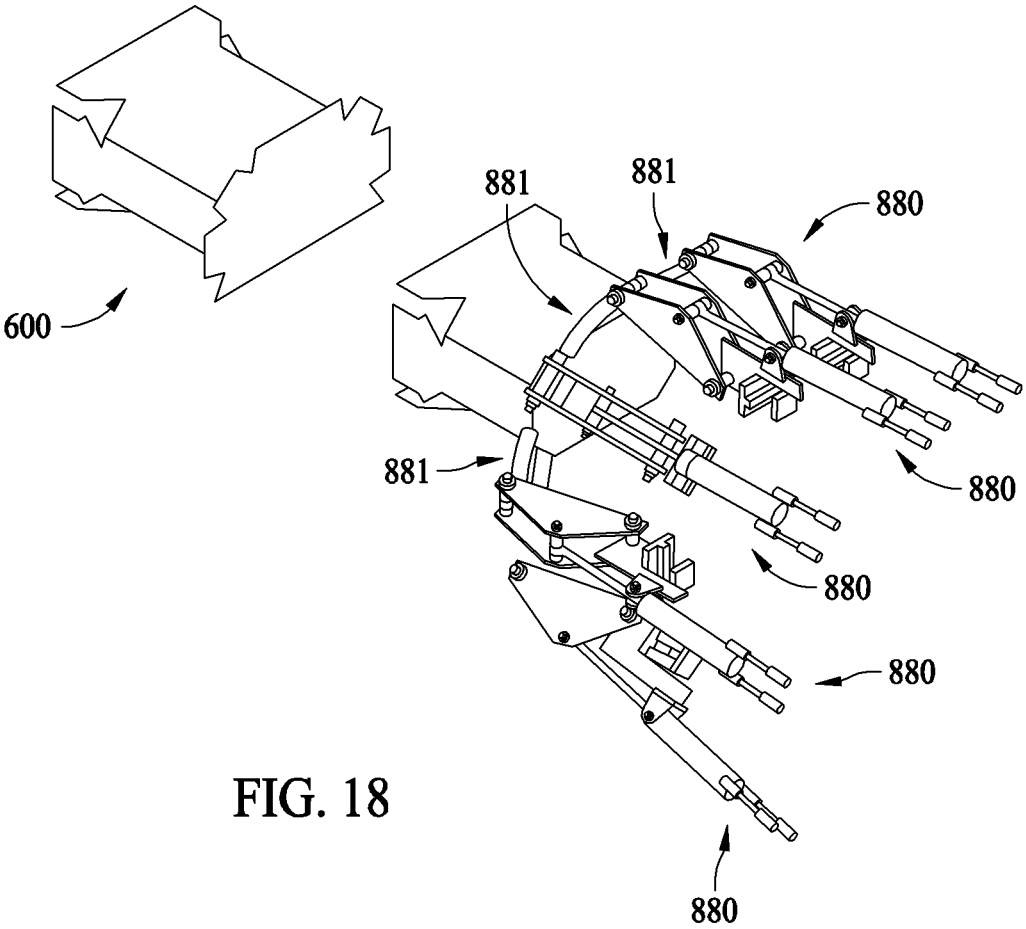
FIG. 18 is an exemplary embodiment of the container as it is formed by actuators of the machine shown in FIG. 5.

In one embodiment, as shown in FIG. 18, an actuator or a plurality of actuators are used as the flange sealing mechanism. After the adhesive to secure flanges 426, 428, 430, 432, 434, 436, 438 is applied, actuator 880 or plurality of actuators 880, each actuator 880 having a plow finger 881, are positioned at an angle to panels 22, 24, 26, 30, 32, 34, 36, and 38. In one embodiment, plurality of actuators 880 has a shape to fit the exterior of mandrel 722. Actuators 880 using the respective plow finger 881 fold and compress flanges 434, 436, 438, 426, 428, 430, and 432 to the corresponding panels. This action applies pressure to the hot melt adhesive, sealing the container. In other embodiments, the flanges are not all simultaneously folded and compressed, but groups of actuators 880, acting separately, fold and compress the corresponding group of flanges to their respective panels.

Figure 17:
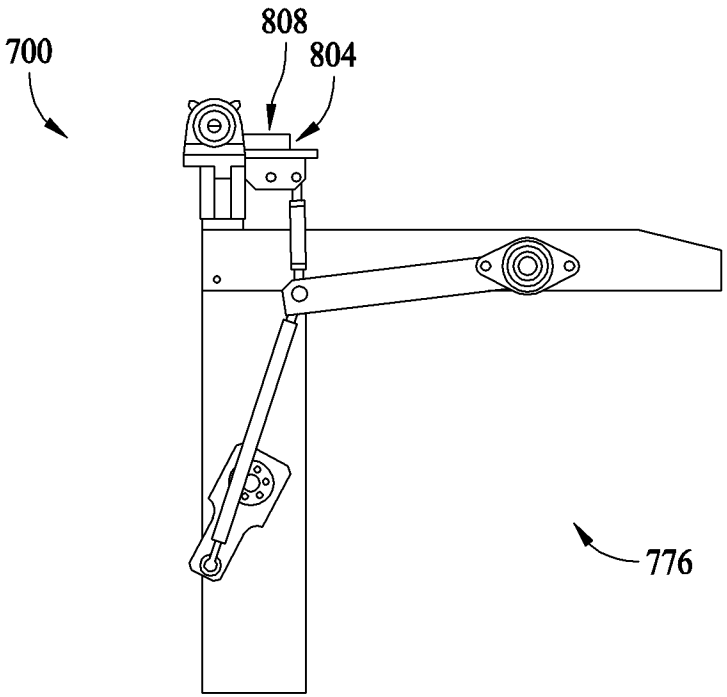
FIG. 17 is a side elevation of an exemplary embodiment of a portion of a bottom member of the machine shown in FIG. 5.
Figure 19:
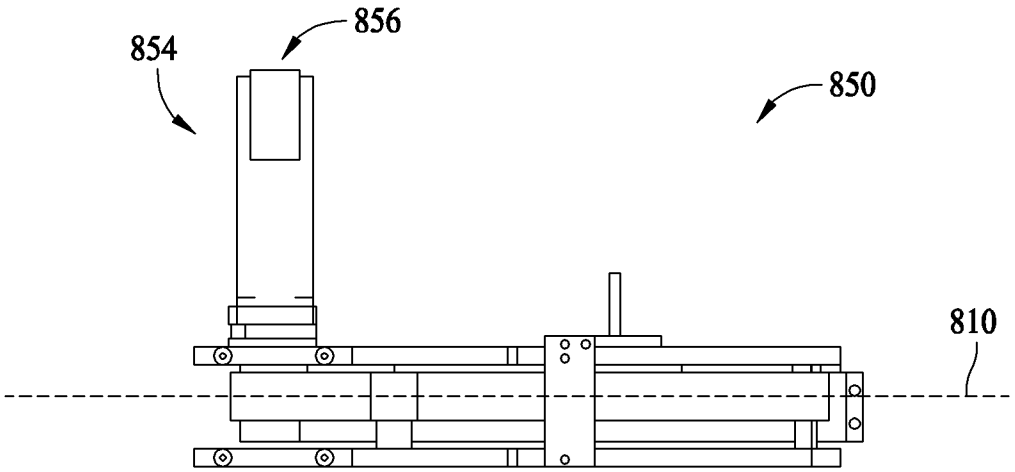
FIG. 19 is a top view of an exemplary embodiment of an ejection mechanism of the machine shown in FIG. 5.
Figure 20:
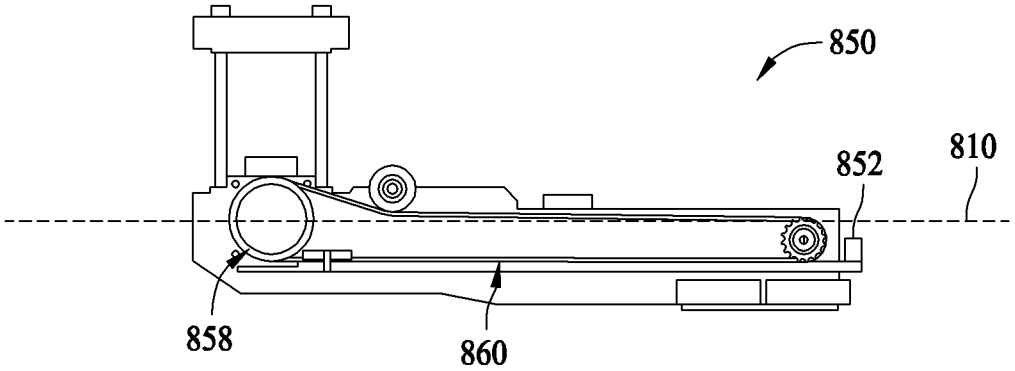
FIG. 20 is a side elevation of the ejection mechanism shown in FIG. 19.

Once flanges 426, 428, 430, 432, 434, 436, 438 are secured to respective sides 634, 636, 622, 624, 626, 630, 632 container 600 is formed except for cover flaps 110, 120, 130, 140, which may be closed (and in some embodiments secured with an adhesive). Container 600 can then be ejected from mandrel 722 and machine 700. Although container 600 may be ejected from mandrel 722 and machine 700 using any suitable mechanism, structure, and/or means, in the exemplary embodiment machine 700 includes an ejection plate mechanism 850 having an ejection plate 852 positioned at least partially between mandrel 722 and bottom 650 that applies a force to an interior surface of bottom 650 to eject container 600 from mandrel 722. More specifically, and as shown in FIGS. 17, 19, and 20, ejection plate 852 is movable along an axis 810 in a direction away from mandrel 722 to eject container 600 from mandrel 722 and machine 700. Although ejection plate 852 may move any distance along axis 810, in some embodiments the ejection plate moves between about 10 and about 30 inches along axis 810 to eject container 600 from mandrel 722 and machine 700. In some embodiments, compression between the ejection plate and the bottom presser element pressing component 804 facilitates compressing adhesive between inner bottom flap 502 and outer bottom flap 402. For example, in some embodiments ejection plate applies a force to inner bottom flap 502 or outer bottom flap 402 in order to facilitate compressing the adhesive.

In one embodiment, ejection mechanism 850 includes a servomechanism 854 for driving and controlling movement of ejection plate 852. Specifically, servomechanism 854 may facilitate controlling a speed and a position of ejection plate 852 more accurately and quickly than without servomechanism 854. In the exemplary embodiment, servomechanism 854 includes an electric motor 856 that includes an output shaft 858 for driving rotation of a conveyor 860 coupled to ejection plate 852.

Figure 21:
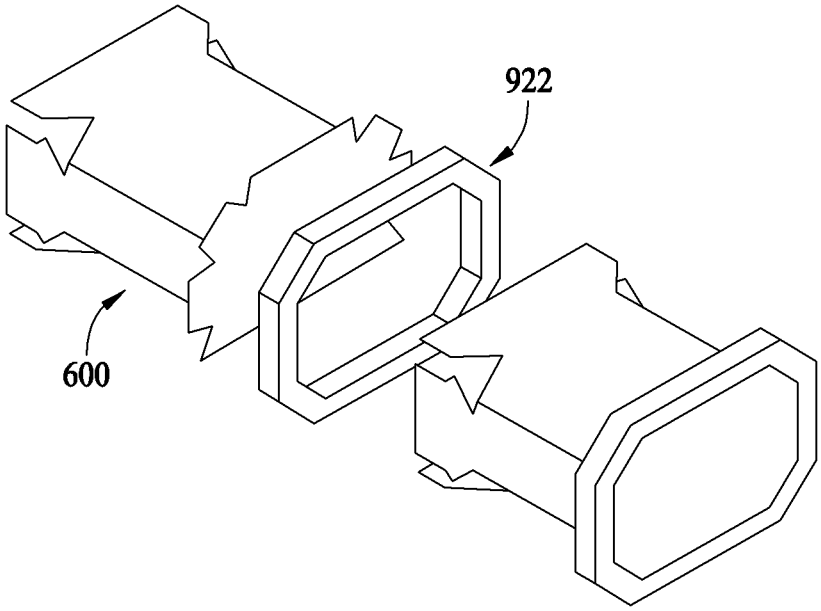
FIG. 21 is an exemplary embodiment of the external mandrel used with the machine shown in FIG. 5.

At least one alternative flange sealing mechanism for securing flanges 426, 428, 430, 432, 434, 436, 438 to respective sides 634, 636, 622, 624, 626, 630, 632, utilizes ejection mechanism 850 (discussed above). After outer bottom flap 402 is secured to inner bottom flap 502 as discussed above, hot melt glue guns 720 apply glue to panels 22, 24, 26, 30, 32, 34, 36. Ejection mechanism 850 (as discussed above) forces the partially formed container in an axially direction away from fixed internal mandrel 722 and into an external mandrel 922. As shown in FIG. 21, an internal surface of external mandrel 922 is configured to correspond to the outer dimensions of container 600. This action forces flanges 426, 428, 430, 432, 434, 436, 438 to respective sides 634, 636, 622, 624, 626, 630, 632. In one embodiment, container 600 remains in external mandrel 922 until the next container is ejected into external mandrel 922, forcing the formed case out of external mandrel 922.

As used herein, any of gripping member 710, pusher assembly 716, lifting assembly 727, flap folder element 734, bottom presser element 776, any other member described and/or illustrated herein, and/or components thereof may be referred to herein as a member, a first member, a second member, and/or a third member.

Exemplary embodiments of blanks, containers, methods, and machines are described and/or illustrated herein in detail. The blanks, containers, methods, and machines are not limited to the specific embodiments described herein, but rather, elements of each blank, container, and machine and steps of each method may be utilized independently and separately from other elements and steps described herein. Each blank, container, and machine element and each method step can also be used in combination with other blank, container, and machine elements and/or method steps.

When introducing elements, components, etc. of the methods and assemblies described and/or illustrated herein, the articles "a", "an", "the" and "said" are intended to mean that there are one or more of the element(s), component(s), etc. The terms "comprising", "including" and "having" are intended to be inclusive and mean that there may be additional element(s), component(s), etc. other than the listed element(s), component(s), etc.

While the invention has been described in terms of various specific embodiments, those skilled in the art will recognize that the invention can be practiced with modification within the spirit and scope of the claims.

What is claimed is:

1. A container formed from a blank sheet of material, the container comprising:

a plurality of side walls formed from a plurality of side panels connected along substantially parallel fold lines, the plurality of side panels comprising a first major panel and a second major panel, each of the plurality of side panels having a length extending in a direction substantially parallel to the fold lines, the plurality of side walls defining a cavity having a bottom and a top, wherein the length of the second major panel is less than the length of each other side panel and the length of the first major panel is greater than the length of each remaining side panel including the second major panel, and wherein a top edge of the first major panel is aligned with a top edge of the second major panel in a plane generally perpendicular to the plurality of side walls;

an outer bottom flap connected to the first major panel along a first edge of a plurality of edges of the outer bottom flap;

an inner bottom flap connected to the second major panel; and a plurality of flanges, one flange connected to each remaining edge of the outer bottom flap, a first flange of the plurality of flanges adjacent to a first side panel of the plurality of side panels and separated from the first side panel by a first cut line, and a second flange of the plurality of flanges adjacent to a second side panel of the plurality of side panels and separated from the second side panel by a second cut line, wherein, when the container is assembled, the inner bottom flap is positioned adjacent to the cavity bottom and the outer bottom flap is positioned adjacent to the inner bottom flap in a face-to-face relationship, the inner bottom flap and the outer bottom flap forming a bottom of the container, wherein each flange is folded and coupled to an outer surface of one side wall of the container.

2. A container in accordance with claim 1 wherein the inner bottom flap comprises a plurality of edges, wherein a first edge of the inner bottom flap is connected to the second major panel and each remaining edge at least partially contacts an inner surface of one side wall of the container.

3. A container in accordance with claim 1 wherein the plurality of side panels comprises a first end panel and a second end panel, wherein the first end panel is coupled to and partially overlaps the second end panel when the container is assembled.

4. A container in accordance with claim 3 wherein the first end panel and the second end panel substantially overlap each other when the container is assembled.

5. A container in accordance with claim 1 wherein the outer bottom flap is configured to substantially cover the inner bottom flap and a thickness of each side panel forming the plurality of side walls of the container.

6. A container in accordance with claim 1 wherein each flange of the plurality of flanges includes a length extending along a corresponding edge of the outer bottom flap, wherein the flange length is greater than a width of the side panel to which the flange is coupled for facilitating reducing openings between the outer bottom flap and the side walls of the container.

7. A container in accordance with claim 1 wherein the outer bottom flap includes a perimeter defined by the plurality of edges of the outer bottom flap, and the cavity bottom includes a perimeter defined by the side walls of the container, wherein the perimeter of the outer bottom flap is greater than the perimeter of the cavity bottom.

8. A container in accordance with claim 1 wherein the length of the second major panel is configured to at least partially accommodate a thickness of the inner bottom flap.

9. A container in accordance with claim 1 wherein the first side panel comprises a first intermediate panel and the second side panel comprises a second intermediate panel, and wherein the remainder of the plurality of side panels further comprises:

a first minor panel, a second minor panel, a third intermediate panel, a first connecting side panel, and a second connecting side panel, wherein the plurality of side panels are connected in a series such that the first connecting side panel is connected to the first minor panel, the first minor panel is connected to the first intermediate panel, the first intermediate panel is connected to the first major panel, the first major panel is connected to the second intermediate panel, the second intermediate panel is connected to the second minor panel, the second minor panel is connected to the third intermediate panel, the third intermediate panel is connected to the second major panel, and the second major panel is connected to the second connecting side panel.

10. A container in accordance with claim 1 wherein the container further comprises a top wall comprising a first major cover flap connected to the first major panel along a fold line at the first major panel top edge and a second major cover flap connected to the second major panel along a fold line at the second major panel top edge, the first major cover flap and the second major cover flap forming the top wall of the container when folded along the corresponding fold lines.

11. A container in accordance with claim 10 wherein each of the first major cover flap and the second major cover flap includes a first notch and a second notch, the first notch and the second notch of each major cover flap are configured to reduce openings between the top of the container and the side walls of the container.

12. A blank of sheet material for constructing a container, the blank comprising:

a plurality of side panels connected in a series along substantially parallel fold lines, the plurality of side panels comprising a first major panel and a second major panel, each of the plurality of side panels having a length extending in a direction substantially parallel to the fold lines, wherein the length of the second major panel is less than the length of each other side panel and the length of the first major panel is greater than the length of each remaining side panel including the second major panel, and wherein a top edge of the first major panel is aligned with a top edge of the second major panel;

an inner bottom flap connected to the second major panel;

an outer bottom flap connected to the first major panel along a first edge of a plurality of edges of the outer bottom flap, the edges defining an outer bottom flap perimeter; and a plurality of flanges, one flange connected to each remaining edge of the outer bottom flap, a first flange of the plurality of flanges adjacent to a first side panel of the plurality of side panels and separated from the first side panel by a first cut line, and a second flange of the plurality of flanges adjacent to a second side panel of the plurality of side panels and separated from the second side panel by a second cut line.

13. A blank of sheet material in accordance with claim 12 wherein the plurality of side panels further comprises a first end panel and a second end panel, each end panel having a width that is one of substantially equal to and less than widths of the other side panels.

14. A blank of sheet material in accordance with claim 12 wherein the blank further comprises a first major cover flap connected to the first major panel along a fold line at the first major panel top edge, and a second major cover flap connected to the second major panel along a fold line at the second major panel top edge.

15. A method for making a container from a blank of sheet material, said method comprising:

providing the blank of sheet material comprising a plurality of side panels connected in a series along substantially parallel fold lines wherein the side panels include a first major panel and a second major panel, each of the plurality of side panels having a length extending in a direction substantially parallel to the fold lines, wherein the length of the second major panel is less than the length of each other side panel and the length of the first major panel is greater than the length of each remaining side panel including the second major panel such that a bottom edge of the first major panel is offset with respect to a bottom edge of the second major panel, an outer bottom flap connected to the first major panel bottom edge along a first edge of a plurality of edges of the outer bottom flap, a plurality of flanges, one flange connected to each remaining edge of the outer bottom flap, and an inner bottom flap connected to the second major panel bottom edge along a fold line, wherein a first flange of the plurality of flanges is adjacent to a first side panel of the plurality of side panels and separated from the first side panel by a first cut line, and a second flange of the plurality of flanges is adjacent to a second side panel of the plurality of side panels and separated from the second side panel by a second cut line;

forming a plurality of side walls of the container by folding the plurality of side panels along the fold lines and coupling at least two of the side panels together, the plurality of side walls defining a cavity having a bottom and a top, each side wall of the container having an interior surface and an exterior surface;

folding the inner bottom flap substantially perpendicular to the second major panel such that the inner bottom flap substantially covers the cavity bottom;

folding the outer bottom flap substantially perpendicular to the first major panel such that the outer bottom panel is adjacent to the inner bottom flap in a face-to-face relationship; and folding each flange along a corresponding fold line and coupling each flange to the exterior surface of a respective side wall of the plurality of side walls, wherein all but one side wall has one of the flanges coupled thereto.

16. A method in accordance with claim 15 wherein the blank further includes a first major cover flap connected to the first major panel along a fold line, and a second major cover flap connected to the second major panel along a fold line, said method further comprising:

folding the first major cover flap along the corresponding fold line such that the first major cover flap is substantially perpendicular to the first major panel; and folding the second major cover flap along the corresponding fold line such that the second major cover flap is substantially perpendicular to the second major panel to form at least a portion of a top of the container.

17. A method in accordance with claim 15 wherein the blank further includes a first minor cover flap connected to a first minor panel along a fold line, and a second minor cover flap connected to a second minor panel along a fold line, said method further comprising:

folding the first minor cover flap along the corresponding fold line such that the first minor cover flap is substantially perpendicular to the first minor panel; and folding the second minor cover flap along the corresponding fold line such that the second minor cover flap is substantially perpendicular to the second minor panel to form at least a portion of a top of the container.

18. A method in accordance with claim 15 wherein folding the outer bottom flap further comprises folding the outer bottom flap substantially perpendicular to the first major panel such that the outer bottom panel is adjacent to the inner bottom flap in a face-to-face relationship, and the outer bottom flap is configured to substantially cover the inner bottom flap and a thickness of each side panel forming the plurality of side walls of the container.

19. A container formed from a blank of sheet material, the container comprising:

each intermediate side panel extending between one of the first and second major side panels and one of the first and second minor side panels, a length of the second major panel is less than a length of each other side panel, and a top edge of the first major side panel is aligned with a top edge of the second major side panel in a plane generally perpendicular to the plurality of side walls, the plurality of side walls defining a cavity having a bottom and a top;

a plurality of side walls formed from a plurality of side panels connected along substantially parallel and longitudinally extending fold lines, the plurality of side panels comprising a first major side panel, a second major side panel, a first minor side panel, a second minor side panel, and a plurality of intermediate side panels, each intermediate side panel extending between one of the first and second major side panels and one of the first and second minor side panels, the plurality of side walls defining a cavity having a bottom and a top;

an outer bottom flap connected to the first major side panel along a first edge of a plurality of edges of the outer bottom flap;

an inner bottom flap connected to the second major side panel;

a plurality of flanges, one flange connected to each remaining edge of the outer bottom flap, a first flange of the plurality of flanges adjacent to a first intermediate side panel of the plurality of intermediate side panels and separated from the first intermediate side panel by a first cut line, and a second flange of the plurality of flanges adjacent to a second intermediate side panel of the plurality of intermediate side panels and separated from the second intermediate side panel by a second cut line; and a top wall comprising a first major cover flap connected to the first major side panel, a second major cover flap connected to the second major side panel, a first minor cover flap connected to the first minor side panel, and a second minor cover flap connected to the second minor side panel, wherein each cover flap includes first and second side edges each extending substantially parallel to a top edge of a respective intermediate side panel of the plurality of intermediate side panels.

20. A container formed from a blank of sheet material, the container comprising:

and a top edge of the first major side panel is aligned with a top edge of the second major side panel in a plane generally perpendicular to the plurality of side walls;

a plurality of side walls formed from a plurality of side panels connected along substantially parallel and longitudinally extending fold lines, the plurality of side panels comprising a first major side panel, a second major side panel, a first minor side panel, a second minor side panel, and a plurality of intermediate side panels, each intermediate side panel extending between one of the first and second major side panels and one of the first and second minor side panels, the plurality of side walls defining a cavity having a bottom and a top, wherein the first major side panel has a first length, the second major side panel has a second length, every other side panel of the plurality of side panels has a third length that is less than the first length and greater than the second length, and a top edge of the first major side panel is aligned with a top edge of the second major side panel;

an outer bottom flap connected to the first major side panel along a first edge of a plurality of edges of the outer bottom flap;

an inner bottom flap connected to the second major side panel;

a plurality of flanges, one flange connected to each remaining edge of the outer bottom flap; and a top wall comprising a first major cover flap connected to the first major side panel at the first major side panel top edge and a second major cover flap connected to the second major side panel at the second major side panel top edge.

* * * * *